US005898956A

United States Patent [19]

Kurisaki et al.

[11] Patent Number: 5,898,956

[45] Date of Patent: May 4, 1999

[54] SANITARY CLEANSING APPARATUS

[75] Inventors: Toshio Kurisaki; Yasuhiro Hamafuku; Yasushi Imma, all of Kitakyushu, Japan

[73] Assignee: Toto Ltd., Fukuoka, Japan

[21] Appl. No.: 08/894,110

[22] PCT Filed: Jan. 18, 1996

[86] PCT No.: PCT/JP96/00102

§ 371 Date: Aug. 12, 1997

§ 102(e) Date: Aug. 12, 1997

[87] PCT Pub. No.: WO96/27053

PCT Pub. Date: Sep. 6, 1996

[30] Foreign Application Priority Data

Feb. 28, 1995 [JP] Japan ..... 7-066784
Nov. 10, 1995 [JP] Japan ..... 7-317451

[51] Int. Cl.[6] ..... A47K 3/20
[52] U.S. Cl. ..... 4/420.4
[58] Field of Search ..... 4/420.2, 420.4

[56] References Cited

U.S. PATENT DOCUMENTS 4,628,548 12/1986 Kurosawa et al. ..... 4/420.4

FOREIGN PATENT DOCUMENTS 5132990 5/1993 Japan ..... 4/420.2
5220061 8/1993 Japan ..... 4/420.2
6-57807 3/1994 Japan .
6-136807 5/1994 Japan .

*Primary Examiner*—Charles E. Phillips
*Attorney, Agent, or Firm*—Beyer & Weaver, LLP

[57] ABSTRACT

Detected temperature TMs of warm water thermistor 28*a*, presence of any or no wire break in nozzle unit 12, attachment completion data by attachment state sensor 17, continuous in-use data by timer 16 and data related to other cleansing function parts and units are read (step S52). If there any abnormal temperatures and wire breaks, these data and other detection data in various conditions are stored in backup RAM while unnecessary data (data at tests in production processes) which are considered as not contributing to investigation of causes of troubles are reset according to function part data, such as attachment completion data and continuous in-use data (step S62). This modification eliminates utilization of data obtained at tests in production process, not during continuous use, as data for investigation into causes when trouble occurs and thus enhances reliability of data.

29 Claims, 8 Drawing Sheets

SANITARY CLEANSING APPARATUS

TECHNICAL FIELD

The present invention relates to a toilet seat apparatus comprising a cleansing function means for cleansing excretory parts of the human body.

BACKGROUND ART

A toilet seat apparatus conventionally known of this type is such as an apparatus comprising a shower nozzle which is driven by a motor to advance and retreat and performing posterior part cleansing, genital part cleansing and other functions by spouting warm water from spouting opening after transferring the shower nozzle to an advanced position at cleansing time. In recent years, addition of diverse functions besides posterior part cleansing and genital part cleansing has been proposed. The diverse functions are, for example, a massage cleansing function to stimulate the posterior parts rhythmically to accelerate smooth defecation through varying the water spouting force approximately every one second during posterior part cleansing, a movable cleansing function to enhance the effect with rocking the shower nozzle back and forth, a cleansing position adjustment function to transfer the shower nozzle back and forth minutely and temperature setting function to select the temperatures of the cleansing water. To exercise these functions, various operating conditions are prescribed pertaining to advancement and retreat of the shower nozzle, valve operation for spouting of warm water, and so on.

Since the operating conditions concerning the shower nozzle, valves and other parts range a wide variety, varied inventions have been made to cope with malfunctioning caused by their abnormal operating conditions, such as ineffective adjustment of spouting water temperatures. For example, since abnormal operating conditions are found in the shower nozzle or the valves when a trouble occurs in such functions as a nozzle apparatus and a spouting water temperature control apparatus, a function to urge repairing it with blinking of an indicator lamp to notify the information.

Provision of a number of indicator lamps, however, to notify warning on the abnormalities is difficult in the aspect of both functions and costs and notification of some information does not demand urgency. Another problem is that it takes long to be repaired when an abnormality occurs since it is difficult to find out the condition of occurrence of the abnormality. Although the above-described toilet seat apparatus exercises diverse functions in response to settings of a user, it is not convenient to use since the settings of the functions are lost at the time of electric power failure and thus data cannot be utilized to analyzes the causes of the troubles.

The object of the present invention pertaining to the toilet seat apparatus equipped with diverse functions and resolving the problems of the prior art is to provide a toilet seat apparatus which allows accurate investigation into causes of the troubles therein.

SUMMARY OF THE INVENTION

As a solution to such problems as above, a toilet seat apparatus or sanitary cleansing apparatus is provided for a toilet assembly including an excretory cleansing mechanism adapted to clean the excretory parts of the human body when sitting upon a toilet seat of the toilet assembly thereof. A cleansing state information generator or controller is adapted to monitor the actual operating conditions of the cleansing mechanism. In response, the cleansing mechanism generates cleansing state signals representing the actual operating conditions thereof. The cleansing apparatus further includes a first memory device configured to chronologically store the cleansing state signals during operation of the controller and in the event of a power loss thereto.

In toilet seat apparatus according to the present invention of the above-described structure, the actual operating conditions of the cleansing function means for cleansing excretory parts of the human body are monitored by the cleansing state information generating means and made into cleansing state information to state the operating conditions thereof. In this case, the operating conditions to be monitored, or the actual phenomena occurring from operation of the cleansing function means, are such as cleansing water spouting force, cleansing water temperatures, cleansing water spouting modes and duration of cleansing water spouting time, and these operating conditions are monitored with various sensors appropriate to monitoring and made into cleansing state information. The cleansing state information to be generated includes, for example, the HIGH/LOW of the cleansing water spouting force, the HIGH/LOW of the cleansing water temperatures (or exact cleansing water temperatures, such as 45° or 43°), the MOVE/MASSAGE of the cleansing water spouting modes and the LONG/SHORT of the duration of cleansing water spouting time (or exact duration of cleansing water spouting time, such as 8 seconds or 10 seconds). These contents of information are stored by the first memory means and kept even at the time of no power supply.

Therefore, if the information stored in the first memory means is read with an appropriate device, for example, a data reader, the actual operating conditions of the cleansing function means are detectable even after expiration of some duration of no power supply to the toilet seat apparatus, and the actual operating conditions stated in the stored and kept information can be utilized as data to be analyzed for investigation into causes of troubles in the cleansing function means. For this reason, investigation into the causes of troubles and repairs based thereon can be executed promptly.

The toilet seat apparatus having the above-described structure may include a first setting device configured to establish set operating conditions of the cleansing mechanism, and a cleansing setting generator adapted to generate cleansing setting signals representing the cleansing mechanism's set operating conditions set by the first setting device. In this embodiment, the first memory device may further be configured to store the cleansing setting signals during operation of the cleansing setting generator and in the event of a power loss thereto.

In this structure, the above-described operating conditions, for example, the ON/OFF of the cleansing function, the HIGH/LOW of the cleansing water spouting force, the HIGH/LOW of the cleansing water temperatures (or exact cleansing water temperatures), the MOVE/MASSAGE of the cleansing water spouting modes and the LONG/SHORT of the duration of cleansing water spouting time (or exact duration of cleansing water spouting time) are set by the first setting means through the operations by the user, and the setting of the operating conditions (hereinafter referred to as set operating conditions, for convenience of description) are made into cleansing setting information by the cleansing setting information generating means. The cleansing setting information is stored by the first memory means for storing the above-described cleansing state information and kept even at the time of no power supply.

Therefore, when the stored information in the first memory means is read by the data reader or a similar device, the set operating conditions in addition to the actual operating conditions of the cleansing function means are detectable even after expiration of some duration of no power supply to the toilet seat apparatus, and the operating conditions stated in the stored and kept information (both of actual operating conditions and set operating conditions) can be utilized as data to be analyzed for investigation into causes of troubles in the cleansing function means. Congruity and incongruity between the set operating conditions and actual operating conditions can be also stored and kept. For this reason, investigation into the causes of troubles and repairs based thereon can be executed more promptly.

The above-described present invention may adopt the following modes.

In the first mode, the sanitary cleansing apparatus according to the present invention may include a drying device configured to dry the excretory parts of the human body when seated upon the toilet seat, and a second setting device configured to establish set operating conditions of the drying mechanism. The controller may further be adapted to monitor the actual operating conditions of the drying device and in response generate drying device condition signals representing the actual operating conditions thereof which are part of the cleansing state signals. The cleansing setting generator is further adapted to generate second setting signals representing the drying device's set operating conditions set by the second setting device which are part of the cleansing setting signals.

In the toilet seat apparatus of this mode, the actual operating conditions of the drying means, or the actual phenomena occurring from operation of the drying means, such as warm air temperatures, warm air flow rates and duration of warm air blowing time, and other operating conditions are monitored with various sensors appropriate to monitoring and information to be added to the cleansing state information is generated. The information to be added to the cleansing state information includes the HIGH/LOW of the warm air temperatures (or exact warm air temperatures, such as 40° or 42°), the HIGH/LOW of the warm air flow rates (or exact warm air flow rates, such as 5 lit./min or 8 lit./min), the LONG/SHORT of the duration of warm air blowing time (or exact duration of warm air blowing time, such as 10 seconds or 20 seconds) and other operating conditions. The operating conditions of the drying means, for example, the ON/OFF of drying, the HIGH/LOW of the warm air temperatures (or exact warm air temperatures), the HIGH/LOW of the warm air flow rates (or exact warm air flow rates) and the LONG/SHORT of the duration of warm air blowing time (or exact duration of warm air blowing time) are set by the second setting means through operation of the user and these set operating conditions are added to the cleansing setting information by the cleansing setting information generating means.

In the toilet seat apparatus of this mode, the cleansing state information and the cleansing setting information with addition of the information concerning the drying means (the information stating the actual operating conditions and the set operating conditions of the drying means) is stored by the first memory means and kept even when no electric power is supplied. For this reason, in the toilet seat apparatus of this mode, the operating conditions of the drying means in addition to the cleansing function means are detectable even after expiration of some duration of no power supply to the toilet seat apparatus, and the actual operating conditions stated in the stored and kept information can be utilized as data to be analyzed for investigation into causes of troubles in these means to promptly execute the investigation into the causes of troubles and the repairs based thereon.

In the second mode of the sanitary cleansing apparatus of the above-described structure, the first memory device includes a first malfunction memory device configured to record and store the circumstances causing malfunction of the controller.

In the toilet seat apparatus of this mode, malfunction of the cleansing state information generating means itself, for example, faulty monitoring of the operating conditions of the cleansing function means or drying means and faulty generation of the cleansing state information or, more concretely, circumstances of occurrence of failures in various sensors monitoring the cleansing water spouting force are stored and kept in addition to the operating conditions of the cleansing function means and the drying means. Therefore, since the circumstances of occurrence of failures in the operating conditions of the cleansing state information generating means itself can be utilized as data to be analyzed for investigation into causes of troubles in the cleansing function means and drying means, the reliability of the analyzed data can be enhanced with the more accurate investigation into the causes of troubles in the apparatus.

An alternative modification of this mode is as follows. That is, the first memory device includes a second malfunction memory device configured to record and store the circumstances causing malfunction of the controller and, record and store the cleansing setting signals at the time of occurrence of the malfunction.

In this structure, since the cleansing setting information when the malfunctioning occurred (for example, the information stating the set operating conditions, such as the HIGH/LOW of the above-described cleansing water spouting force and the HIGH/LOW of the warm air temperature) in addition to the circumstances wherein malfunction of the cleansing state information generating means itself occurred can be utilized as data to be analyzed for investigation into causes of troubles in the cleansing function means and drying means, the of the analyzed data can be enhanced further with the more accurate investigation into the causes of troubles in the apparatus.

In the third mode, the sanitary cleansing apparatus according to the present invention described above includes an environment monitoring mechanism adapted to monitor the actual state of the ambient environment of the toilet assembly. The first memory device further includes an environment memory device configured to record and store the actual state of the ambient environment of the toilet assembly as monitored by the monitoring mechanism.

In the toilet seat apparatus of this mode, the state of the ambient environment of the toilet bowl, for example, the ambient temperatures of the toilet bowl (room temperatures) and humidities, are stored and kept in addition to the operating conditions of the cleansing function means and the drying means. Therefore, the operating conditions of the cleansing state information generating means and the drying means (either or both of the actual operating conditions and set operating conditions) can be compared with the ambient environment of the toilet bowl and thus causes of the trouble in the apparatus can be investigated from various aspects through utilization of the data concerning the environment wherein the toilet bowl is located at the time of investigating into the causes of the troubles in the cleansing function means and the drying means.

In the fourth mode, the sanitary cleansing apparatus according to the present invention described above includes a use circumstance monitoring device configured to monitor the use circumstances of said cleansing mechanism. A memory result modification device may be provided which is adapted to modify the memory results in the first memory device according to the monitored results of the use circumstance monitoring device.

In the toilet seat apparatus of this mode, the use circumstances of the cleansing function means, for example, circumstances of power supply to the toilet seat apparatus, circumstances of continuation of attachment of the toilet seat apparatus to the toilet bowl, number of times to use the cleansing function means, and number of times to attach and detach the toilet seat apparatus to and from the toilet bowl, are monitored by the use circumstance monitoring means. Therefore, the monitored results prove whether usual use circumstances wherein the toilet seat apparatus is attached to the toilet bowl and used in usual ways or unusual use circumstances, for example, test use circumstances of functional tests in a production process or in a repairing process. Modification of the memory results in the first memory means, based on the monitored results of the use circumstance monitoring means, can produce such effects as described below.

For the investigation into the causes, it is effective to accumulate various data of operating conditions of each functional parts that constitutes the cleansing function means and drying means, for example, the shower nozzle, valves, and warm air blowing device in the drying apparatus till occurrence of a trouble and to utilize the data. Actual machine tests are normally performed on each of the cleansing function parts of this type of toilet seat apparatus, such as the nozzle apparatus, the spouting water temperature control apparatus and the drying apparatus, in the production processes. The tests are performed respectively in each process along the production line; for example, if the first process is the assembly process of the drying-associated parts, the operating conditions are tested with power supplied to the fully assembled drying-associated parts in this process. In the succeeding second process (assembly process of the cleansing-associated parts), the operating conditions are tested with power supplied to the fully assembled cleansing-associated parts. In these processes, the toilet seat is normally removed for better working efficiency at the time of tests, the toilet seat is assembled in the final process.

In the first process, the cleansing-associated parts that are not assembled completely yet are treated as in a wire breakage states since power cannot be supplied to and the tests are performed in the drying-associated parts. Therefore, simple data accumulation concerning the cleansing-associated parts will include the data at this test and such data may be utilized in investigation into the causes of the troubles. Consequently, some fear is aroused that confusion in the investigation into the causes of the troubles and in measures taken on the basis of the investigation results at the time of repair and thus delay in recovery from the troubles may be resulted in.

At the time of actual repair, for the convenience of repair and inspection of the cleansing function parts, for example, the spouting water temperature control apparatus or drying apparatus, these cleansing function parts, or the object of repair, may be situated in such operating conditions as the parts are not used for usual uses. For example, in a case of the spouting water temperature control apparatus, the temperature may be increased once beyond the appropriate range of normal uses. Accumulation of the data of such a case as above arouses some fear that, if the data is utilized by mistake for investigation into the causes of the troubles of a succeeding case, confusion may arise in the investigation into the causes of the troubles and in measures based on the investigation at the time of repair and result in failure in recovery from the troubles.

The above-described production line operations and repair work are performed with the toilet seat apparatus detached from the toilet bowl, and the toilet seat apparatus is not in the usual use circumstances.

However, since the toilet seat apparatus in the above-described mode modifies the memory results in the first memory means according to the monitored results of the monitoring of the use circumstances of the cleansing function means, it is possible that the operating conditions of the cleansing function means (either or both of the actual operating conditions and the set operating conditions), which are directly connected to the causes of the trouble, and the operating conditions of the cleansing function means and drying means (either or both of the actual operating conditions and the set operating conditions) in a case wherein actual operating conditions and set operating conditions are added to are stored and kept in the memory means under the usual use circumstances of the toilet seat apparatus while the above-described operating conditions of the cleansing function means and drying means are modified from the memory results in the memory means by a method of modification, such as deletion or exclusion, under the unusual use circumstances at the time of production processes or repair. Therefore, the memory results of the operating conditions in the production processes and during the repair can be deleted or excluded from the object of analysis at the time of investigation into the causes of troubles in the toilet seat apparatus. Consequently, the toilet seat apparatus in this mode can enhance reliability in the utilization of the operating conditions stored and kept even at the time of no power supply as analysis data to investigate into the causes of troubles in the cleansing function means and the drying means, and thus the causes of the troubles in the apparatus can be investigated accurately.

In the fifth mode, the sanitary cleansing apparatus according to the present invention described above includes a use circumstance monitoring device configured to monitor the use circumstances of the cleansing mechanism. A memory result modification device may further be included which is adapted to modify the information to be stored by the first memory device according to the monitored results of the use circumstance monitoring device.

In the toilet seat apparatus of this mode, the above-described monitored results of the use circumstances of the cleansing function means and the drying means prove whether the use circumstances of the toilet seat apparatus were the usual use circumstances or the unusual use circumstances. Modification of the information to be stored by the first memory means, based on the monitored results of the use circumstance monitoring means, will produce such effects as described below.

Although the simple data accumulation includes the data of operating conditions at the time of the actual machine tests in production lines, repair or inspection, as described above, the toilet seat apparatus in this mode can annihilate the information to be stored by the first memory means while in the production processes or during the repair. That is, it is possible that the toilet seat apparatus in this mode stores the operating conditions of the cleansing function means and drying means (either or both of the actual operating conditions and the set operating conditions) in the usual use circumstances except for any information while in the production processes or during the repair. Consequently, the toilet seat apparatus in this mode can also enhance reliability in the utilization of the operating conditions stored and kept even at the time of no power supply as analysis data to investigate into the causes of troubles in the cleansing function means and the drying means, and thus the causes of the troubles in the apparatus can be investigated accurately.

The annihilation of the information to be stored by the first memory means denotes inhibition of storing in the first memory means and suspension of the annihilation of such information denotes authorization of storage in the first memory means. Therefore, a structure wherein the storing of the information of the above-described operating conditions of the cleansing function means and the drying means in the first memory means is authorized under the usual use circumstances whereas the storing of the information in the first memory means is inhibited while in the production processes or during the repair excludes the operating conditions while in the production processes or during the repair from the analysis data for investigation into the causes of troubles in the cleansing function means and the drying means from the start. Therefore, this structure can also enhance the reliability in utilization of the operating conditions stored and kept even at the time of no power supply as analysis data to investigate into the causes of troubles in the cleansing function means and the drying means, and thus the causes of the troubles in the apparatus can be investigated accurately.

In the sixth mode, the sanitary cleansing apparatus according to the present invention described above includes a forced modification mechanism adapted to forcibly modify the memory results in the first memory device.

In the toilet seat apparatus of this mode, the operating conditions of the cleansing function means and the drying means (either or both of the actual operating conditions and the set operating conditions) that are memory results of the first memory means, for example, the HIGH/LOW of the above-described cleansing water force, the HIGH/LOW of the warm air temperature and other similar information are modified forcibly by the forced modification means.

Therefore, the operating conditions of the cleansing function means and the drying means, which are directly connected to the causes of the troubles that occur under usual use circumstances or under long-time use, are stored and kept in the first memory means so long as they are not modified forcibly by the forced modification means. However, the operating conditions of the cleansing function means and drying means under unusual use circumstances of the toilet seat apparatus, for example, the operating conditions in the production processes or during the repair are forcibly modified from the memory results in the first memory means by the forced modification means, such as deletion or exclusion as a method of modification by an operator in charge of production or repair or by a timer. Accordingly, the memory results of the operating conditions in the production processes or during the repair can be forcibly deleted or excluded from the object of the analysis at the time of investigation into the causes of the troubles in the toilet seat apparatus. Consequently, the toilet seat apparatus in this mode can also enhance the reliability in utilization of the operating conditions stored and kept even at the time of no power supply as analysis data to investigate into the causes of troubles in the cleansing function means and the drying means, and thus the causes of the troubles in the apparatus can be investigated accurately.

In the seventh mode, the sanitary cleansing apparatus according to the present invention described above includes a toilet seat heating mechanism adapted to heat the toilet seat, and a toilet seat state generator adapted to monitor the actual operating conditions of the toilet seat heating mechanism. In response, the toilet seat state generator generates toilet seat state signals representing the actual operating conditions thereof. The first memory device further includes a second memory device configured to chronologically store the toilet seat state signals during operation of the heating mechanism, and in the event of a power loss thereto.

In the toilet seat apparatus in this mode, the actual operating conditions of the toilet seat heating means are monitored by the toilet seat state information generating means and made into the toilet seat state information to state the operating conditions thereof. In this case, the operating conditions to be monitored, or actual phenomena which occur through operation of the toilet seat heating means are such as toilet seat temperatures and duration of toilet seat heating time, and these operating conditions are monitored with various sensors appropriate to monitoring and made into the toilet seat state information. The toilet seat state information to be generated are, for example, the HIGH/LOW of the toilet seat temperatures (or exact toilet seat temperatures, such as 45° or 43°) and the duration of the toilet seat heating time (a concrete toilet seat heating time excluding the hours in the middle of the night) These contents of information is stored and kept even at the time of no power supply by the second memory means of the first memory means.

Therefore, when the information stored in the first and second memory means is read by the data reader or a similar device, the actual operating conditions of the toilet seat heating means in addition to the cleansing function means and the drying means are detectable even after expiration of some duration of no power supply to the toilet seat apparatus, and the actual operating conditions stated in the stored and kept information can be utilized as data to be analyzed for investigation into causes of troubles in the toilet seat heating means as well as in the cleansing function means and the drying means. For this reason, investigation into the causes of troubles in the apparatus and repairs based thereon can be executed promptly.

The toilet seat apparatus having the above-described structure desirably includes a third setting device configured to establish set operating conditions of the toilet seat heating mechanism. A toilet seat setting generator is adapted to generate toilet seat setting signals representing the toilet seat heating mechanism's set operating conditions set by the third setting device. The second memory device is further configured to chronologically store the toilet seat setting signals during operation of the heating mechanism, and in the event of a power loss thereto.

In this structure, the above-described operating conditions, for example, the ON/OFF of the cleansing function, the HIGH/LOW of the cleansing water spouting force, the HIGH/LOW of the cleansing water temperatures (or exact cleansing water temperatures), the MOVE/MASSAGE of the cleansing water spouting modes and the LONG/SHORT of the duration of cleansing water spouting time (or exact duration of cleansing water spouting time) are set by the first setting means through the operations by the user, and the setting of the operating conditions (hereinafter referred to as set operating conditions, for convenience of description) are made into cleansing setting information by the cleansing setting information generating means. The cleansing setting information is stored by the first memory means for storing the above-described cleansing state information and kept even at the time of no power supply.

Therefore, when the stored information in the first and second memory means is read by the data reader or a similar device, the actual operating conditions and the set operating conditions of the toilet seat heating means in addition to the cleansing function means and the drying means are detectable even after expiration of some duration of no power supply to the toilet seat apparatus, and the operating conditions stated in the stored and kept information (both of actual operating conditions and set operating conditions) can be utilized as data to be analyzed for investigation into causes of troubles in the cleansing function means, the drying means and the toilet seat heating means. Therefore, congruity and incongruity between the set operating conditions and actual operating conditions can be also stored and kept. For this reason, investigation into the causes of troubles and repairs based thereon can be executed more promptly.

In the eighth mode, the sanitary cleansing apparatus according to the present invention described above includes a use circumstance monitoring device configured to monitor the use circumstances of the cleansing mechanism and the toilet seat heating mechanism. A memory result modification device is adapted to modify the memory results in the first and second memory devices according to the monitored results of the use circumstance monitoring device.

In the toilet seat apparatus of this mode, the use circumstances of the toilet seat heating means in addition to the cleansing function means and the drying means, such as circumstances of power supply to the toilet seat apparatus, circumstances of continuation of attachment of the toilet seat apparatus to the toilet bowl, number of times to use the cleansing function means and number of times to attach and detach the toilet seat apparatus to and from the toilet bowl, are monitored by the use circumstance monitoring means Since the monitored results prove whether the toilet seat apparatus was used under usual use circumstances or unusual use circumstances, modification of the memory results in the first and second memory means, based on the monitored results of the use circumstance monitoring means, can produce such effects as described below.

That is, the toilet seat apparatus in this mode also can store and keep the operating conditions of the cleansing function means, the drying means and the toilet seat heating means (either or both of the actual operating conditions and the set operating conditions), which are directly connected to the causes of the trouble, in the first and second memory means under the usual use circumstances of the toilet seat apparatus while the above-described operating conditions of the cleansing function means, drying means and the toilet seat heating means are modified from the memory results in these memory means by a method of modification, such as deletion or exclusion, under the unusual use circumstances at the time of production processes or repair. Therefore, the memory results of the operating conditions in the production processes and during the repair can be deleted or excluded from the object of analysis at the time of investigation into the causes of troubles in the toilet seat apparatus. Consequently, the toilet seat apparatus in this mode can enhance reliability in the utilization of the operating conditions stored and kept even at the time of no power supply as analysis data to investigate into the causes of troubles in the cleansing function means and drying means, and thus the causes of the troubles in the apparatus can be investigated accurately.

In the ninth mode, the sanitary cleansing apparatus according to the present invention described above includes a use circumstance monitoring device configured to monitor the use circumstances of the cleansing mechanism and the toilet seat heating mechanism. A memory result modification device is adapted to modify the information to be stored by the first and second memory devices according to the monitored results of the use circumstance monitoring device.

In the toilet seat apparatus of this mode, the above-described monitored results of the use circumstances of the cleansing function means and the toilet seat heating means prove whether the use circumstances of the toilet seat apparatus were the usual use circumstances or the unusual use circumstances Modification of the information to be stored by the first and second memory means, based on the monitored results of the use circumstance monitoring means, will produce such effects as described below.

That is, it is possible that the toilet seat apparatus in this mode stores the operating conditions of the cleansing function means, drying means and the toilet seat heating means (either or both of the actual operating conditions and the set operating conditions) in the usual use circumstances except for any information while in the production processes or during the repair. Consequently, the toilet seat apparatus in this mode can also enhance reliability in the utilization of the operating conditions stored and kept even at the time of no power supply as analysis data to investigate into the causes of troubles in the cleansing function means, the drying means and the toilet seat heating means, and thus the causes of the troubles in the apparatus can be investigated accurately.

In the tenth mode, the sanitary cleansing apparatus according to the present invention described above includes an ambient heating mechanism adapted to heat the ambient environment of the toilet assembly, and an ambient state generator adapted to monitor the actual operating conditions of the ambient heating mechanism. In response, the ambient state generator generates ambient state signals representing the actual operating conditions thereof. The first memory device further includes a third memory device configured to chronologically store the ambient state signals during operation of the ambient heating mechanism, and in the event of a power loss thereto.

In the toilet seat apparatus in this mode, the actual operating conditions of the ambient heating means are monitored by the ambient state information generating means and made into the ambient state information to state the operating conditions thereof. In this case, the operating conditions to be monitored, or actual phenomena which occur through operation of the ambient heating means are such as ambient temperatures (room temperatures) and duration of ambient heating time, and these operating conditions are monitored with various sensors appropriate to monitoring and made into the ambient state information. The ambient state information to be generated are, for example, the HIGH/LOW of the ambient temperatures (or exact ambient temperatures, such as 45° or 43°) and the duration of the ambient heating time (or exact ambient heating time). These contents of information is stored and kept even at the time of no power supply by the third memory means of the first memory means Therefore, when the information stored in the first and third memory means is read by the data reader or a similar device, the actual operating conditions of the ambient heating means in addition to the cleansing function means and the drying means are detectable even after expiration of some duration of no power supply to the toilet seat apparatus, and the actual operating conditions stated in the stored and kept information can be utilized as data to be analyzed for investigation into causes of troubles in the cleansing function means, the drying means and the ambient heating means. For this reason, investigation into the causes of troubles in the apparatus and repairs based thereon can be executed promptly.

The toilet seat apparatus having the above-described structure desirably includes a fourth setting device configured to establish set operating conditions of the ambient heating mechanism. An ambient setting generator adapted is provided to generate ambient setting signals representing the ambient heating mechanism's set operating conditions set by the fourth setting device. The third memory device is further configured to chronologically store the ambient setting signals during operation of the ambient heating mechanism and in the event of a power loss thereto.

In this structure, the above-described operating conditions, for example, the ON/OFF of the ambient heating, the HIGH/LOW of the ambient temperatures (or exact ambient temperatures), the ON/OFF of the ambient heater timer, the duration of ambient heating time and other conditions are set by the fourth setting means through the operations by the user, and the setting of the operating conditions are made into the ambient setting information by the ambient setting information generating means. The ambient setting information is stored by the third memory means for storing the above-described ambient state information and kept even at the time of no power supply.

Therefore, when the stored information in the first and third memory means is read by the data reader or a similar device, the actual operating conditions and the set operating conditions of the ambient heating means in addition to the cleansing function means and the drying means are detectable even after expiration of some duration of no power supply to the toilet seat apparatus, and the operating conditions stated in the stored and kept information (both of actual operating conditions and set operating conditions) can be utilized as data to be analyzed for investigation into causes of troubles in the cleansing function means, the drying means and the ambient heating means. Therefore, congruity and incongruity between the set operating conditions and actual operating conditions can be also stored and kept. For this reason, investigation into the causes of troubles and repairs based thereon can be executed more promptly.

In the eleventh mode, the sanitary cleansing apparatus according to the present invention described above includes a use circumstance monitoring device configured to monitor the use circumstances of the cleansing mechanism and the ambient heating mechanism. A memory result modification device is adapted to modify the memory results in the first and third memory devices according to the monitored results of the use circumstance monitoring device.

In the toilet seat apparatus of this mode, the use circumstances of the ambient heating means in addition to the cleansing function means and the drying means, such as circumstances of power supply to the toilet seat apparatus, circumstances of continuation of attachment of the toilet seat apparatus to the toilet bowl, number of times to use the cleansing function means and the ambient heating means and number of times to attach and detach the toilet seat apparatus to and from the toilet bowl, are monitored by the use circumstance monitoring means. Since the monitored results prove whether the toilet seat apparatus was used under usual use circumstances or unusual use circumstances, modification of the memory results in the first and third memory means, based on the monitored results of the use circumstance monitoring means, can produce such effects as described below.

That is, the toilet seat apparatus in this mode also can store and keep the operating conditions of the cleansing function means, the drying means and the ambient heating means (either or both of the actual operating conditions and the set operating conditions), which are directly connected to the causes of the trouble, in the first and third memory means under the usual use circumstances of the toilet seat apparatus while the above-described operating conditions of the cleansing function means, drying means and the ambient heating means are modified from the memory results in these memory means by a method of modification, such as deletion or exclusion, under the unusual use circumstances at the time of production processes or repair. Therefore, the memory results of the operating conditions in the production processes and during the repair can be deleted or excluded from the object of analysis at the time of investigation into the causes of troubles in the toilet seat apparatus. Consequently, the toilet seat apparatus in this mode can enhance reliability in the utilization of the operating conditions stored and kept even at the time of no power supply as analysis data to investigate into the causes of troubles in the cleansing function means and drying means, and thus the causes of the troubles in the apparatus can be investigated accurately.

In the twelfth mode, the sanitary cleansing apparatus according to the present invention described above includes a use circumstance monitoring device configured to monitor the use circumstances of the cleansing mechanism and the ambient heating mechanism. A memory result modification device is adapted to modify the information to be stored by the first and third memory devices according to the monitored results of the use circumstance monitoring device.

In the toilet seat apparatus of this mode, the above-described monitored results of the use circumstances of the cleansing function means and the ambient heating means prove whether the use circumstances of the toilet seat apparatus were the usual use circumstances or the unusual use circumstances. Modification of the information to be stored by the first and third memory means, based on the monitored results of the use circumstance monitoring means, will produce such effects as described below.

That is, it is possible that the toilet seat apparatus in this mode stores the operating conditions of the cleansing function means, drying means and the ambient heating means (either or both of the actual operating conditions and the set operating conditions) in the usual use circumstances except for any information while in the production processes or during the repair. Consequently, the toilet seat apparatus in this mode can also enhance reliability in the utilization of the operating conditions stored and kept even at the time of no power supply as analysis data to investigate into the causes of troubles in the cleansing function means, the drying means and the ambient heating means, and thus the causes of the troubles in the apparatus can be investigated accurately.

In the thirteenth mode, the sanitary cleansing apparatus according to the present invention described above includes a deodorizing mechanism adapted to deodorize odious smell inside the toilet assembly, and a deodorizing state generator adapted to monitor the actual operating conditions of the deodorizing mechanism. In response, the deodorizing mechanism generates deodorizing state signals representing the actual operating conditions thereof. The first memory device further includes a fourth memory device configured to chronologically store the deodorizing state signals during operation of the deodorizing mechanism, and in the event of a power loss thereto.

In the toilet seat apparatus in this mode, the actual operating conditions of the deodorizing means are monitored by the deodorizing state information generating means and made into the deodorizing state information to state the operating conditions thereof. In this case, the operating conditions to be monitored, or actual phenomena which occur through operation of the deodorizing means are such as existence of odious smell and discharge of ozonizer, and these operating conditions are monitored with various sensors appropriate to monitoring and made into the deodorizing state information. The deodorizing state information is stored and kept even at the time of no power supply by the fourth memory means of the first memory means.

Therefore, when the information stored in the first and fourth memory means is read by the data reader or a similar device, the actual operating conditions of the deodorizing means in addition to the cleansing function means and the drying means are detectable even after expiration of some duration of no power supply to the toilet seat apparatus, and the actual operating conditions stated in the stored and kept information can be utilized as data to be analyzed for investigation into causes of troubles in the cleansing function means, the drying means and the deodorizing means. For this reason, investigation into the causes of troubles in the apparatus and repairs based thereon can be executed promptly.

The toilet seat apparatus having the above-described structure desirably includes a fifth setting device configured to establish set operating conditions of the deodorizing mechanism. A deodorizing setting generator is adapted to generate deodorizing setting signals representing the deodorizing mechanism's set operating conditions set by the fifth setting device. The fourth memory device is further configured to chronologically store the deodorizing setting signals during operation of the deodorizing mechanism and in the event of a power loss thereto.

In this structure, the above-described operating conditions, for example, the ON/OFF of the deodorizer, the ON/OFF of the deodorizer timer, the duration of deodorizing time and other conditions are set by the fifth setting means through the operations by the user, and the setting of the operating conditions are made into the deodorizing setting information by the deodorizing setting information generating means. The deodorizing setting information is stored by the fourth memory means for storing the above-described deodorizing state information and kept even at the time of no power supply.

Therefore, when the stored information in the first and third memory means is read by the data reader or a similar device, the actual operating conditions and the set operating conditions of the deodorizing means in addition to the cleansing function means and the drying means are detectable even after expiration of some duration of no power supply to the toilet seat apparatus, and the operating conditions stated in the stored and kept information (both of actual operating conditions and set operating conditions) can be utilized as data to be analyzed for investigation into causes of troubles in the cleansing function means, the drying means and the deodorizing means. Therefore, congruity and incongruity between the set operating conditions and actual operating conditions can be also stored and kept. For this reason, investigation into the causes of troubles and repairs based thereon can be executed more promptly.

In the fourteenth mode, the sanitary cleansing apparatus according to the present invention described above includes a use circumstance monitoring device configured to monitor the use circumstances of the cleansing mechanism and the deodorizing mechanism. A memory result modification device is adapted to modify the memory results in the first and fifth memory devices according to the monitored results of the use circumstance monitoring device.

In the toilet seat apparatus of this mode, the use circumstances of the deodorizing means in addition to the cleansing function means and the drying means, such as circumstances of power supply to the toilet seat apparatus, circumstances of continuation of attachment of the toilet seat apparatus to the toilet bowl, number of times to use the cleansing function means and the deodorizing means and number of times to attach and detach the toilet seat apparatus to and from the toilet bowl, are monitored by the use circumstance monitoring means. Since the monitored results prove whether the toilet seat apparatus was used under usual use circumstances or unusual use circumstances, modification of the memory results in the first and fourth memory means, based on the monitored results of the use circumstance monitoring means, can produce such effects as described below.

That is, the toilet seat apparatus in this mode also can store and keep the operating conditions of the cleansing function means, the drying means and the deodorizing means (either or both of the actual operating conditions and the set operating conditions), which are directly connected to the causes of the trouble, in the first and fourth memory means under the usual use circumstances of the toilet seat apparatus while the above-described operating conditions of the cleansing function means, drying means and the deodorizing means are modified from the memory results in these memory means by a method of modification, such as deletion or exclusion, under the unusual use circumstances at the time of production processes or repair. Therefore, the memory results of the operating conditions in the production processes and during the repair can be deleted or excluded from the object of analysis at the time of investigation into the causes of troubles in the toilet seat apparatus. Consequently, the toilet seat apparatus in this mode can enhance reliability in the utilization of the operating conditions stored and kept even at the time of no power supply as analysis data to investigate into the causes of troubles in the cleansing function means and drying means, and thus the causes of the troubles in the apparatus can be investigated accurately.

In the fifteenth mode, the sanitary cleansing apparatus according to the present invention described above includes a use circumstance monitoring device configured to monitor the use circumstances of the cleansing mechanism and the deodorizing mechanism. A memory result modification device is adapted to modify the information to be stored by the first and fourth memory devices according to the monitored results of the use circumstance monitoring device.

In the toilet seat apparatus of this mode, the above-described monitored results of the use circumstances of the cleansing function means and the deodorizing means prove whether the use circumstances of the toilet seat apparatus were the usual use circumstances or the unusual use circumstances. Modification of the information to be stored by the first and fourth memory means, based on the monitored results of the use circumstance monitoring means, will produce such effects as described below.

That is, it is possible that the toilet seat apparatus in this mode stores the operating conditions of the cleansing function means, drying means and the deodorizing means (either or both of the actual operating conditions and the set operating conditions) in the usual use circumstances except for any information while in the production processes or during the repair. Consequently, the toilet seat apparatus in this mode can also enhance reliability in the utilization of the operating conditions stored and kept even at the time of no power supply as analysis data to investigate into the causes of troubles in the cleansing function means, the drying means and the deodorizing means, and thus the causes of the troubles in the apparatus can be investigated accurately.

BEST MODE FOR CARRYING OUT INVENTION

Figure 1:
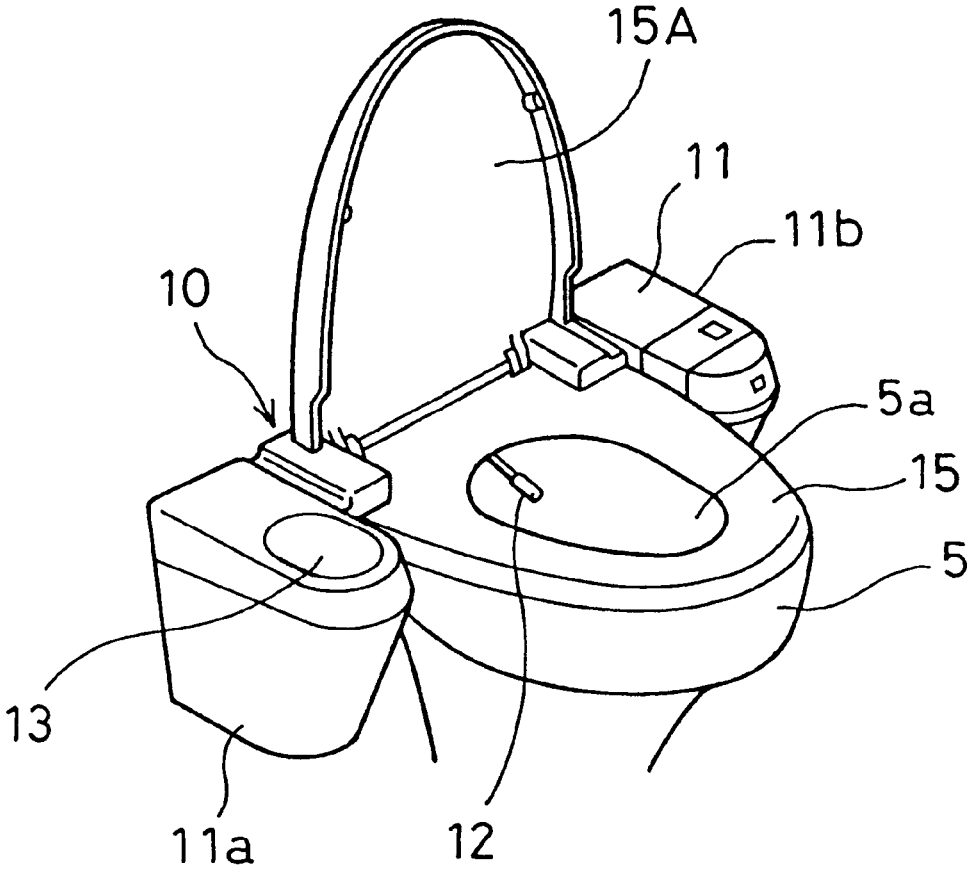
FIG. 1 is an external view of a western style toilet bowl with a toilet seat apparatus mounted thereon as an embodiment of the present invention.
Figure 2:
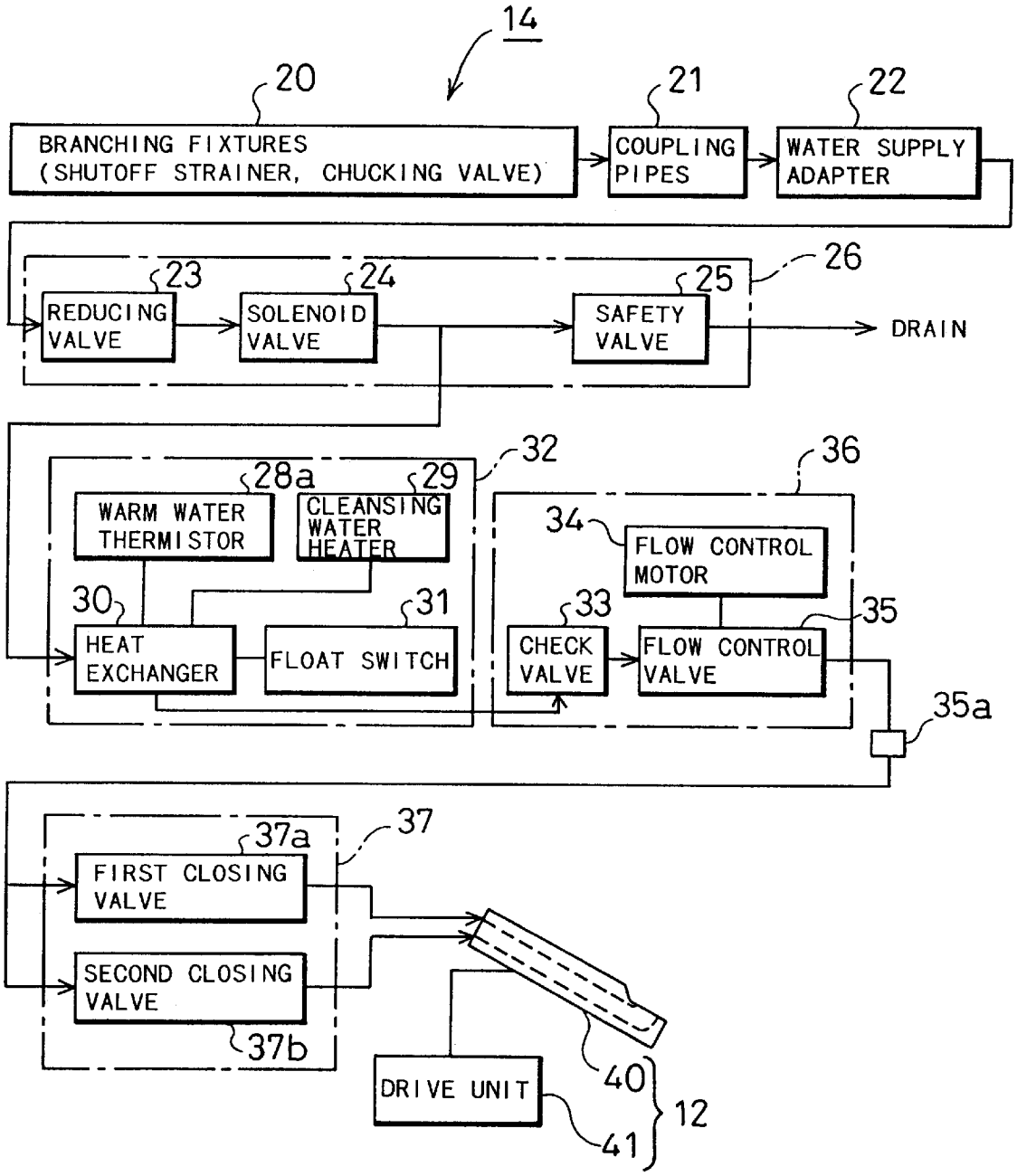
FIG. 2 is a block diagram showing the warm water/shower nozzle control unit of the toilet seat apparatus.
Figure 3:
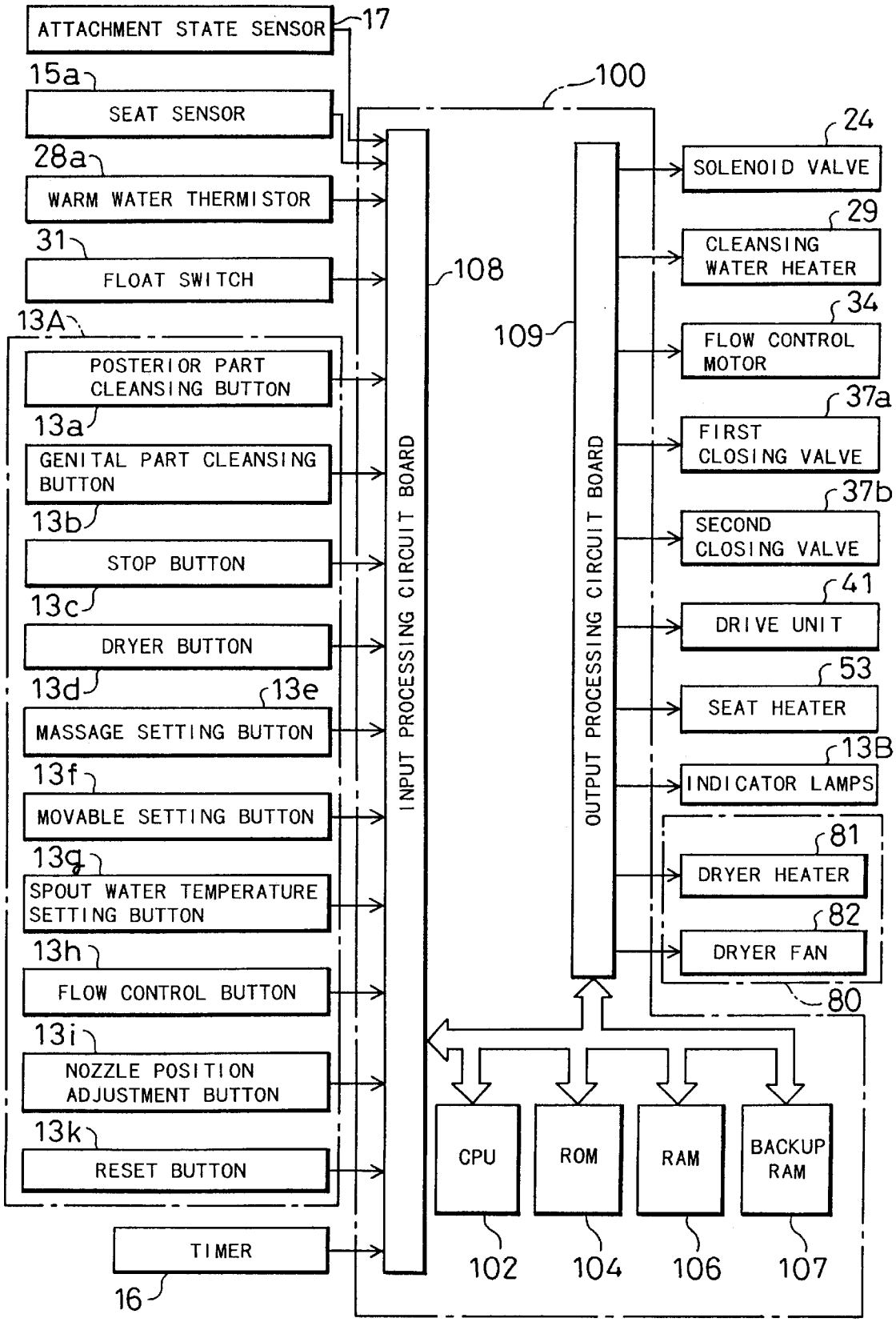
FIG. 3 is a block-diagram showing the electronic controller and the input/output devices thereof.

The modes of implementing the toilet seat apparatus related to the present invention are described below with references to the embodiments. FIG. 1 is an external view of a western style toilet bowl with a toilet seat apparatus 10 attached thereto as an embodiment of the present invention; FIG. 2 is a block diagram showing the warm water/shower nozzle controller of the toilet seat apparatus; and FIG. 3 is a block diagram showing the electronic controller and the input/output devices thereof. The toilet seat apparatus 10 which comprises basic functions of the toilet seat (excretory part cleansing, drying and seat heating), can be equipped with either or both of a heater for heating the ambience of the toilet bowl by blowing warm air to the ambience of the toilet bowl and a deodorizer for removing odious smell with ozone generated by an ozonizer which sucks air inside the bowl part of the toilet bowl. In this case, the heater and the deodorizer are incorporated in the wings of the toilet seat apparatus 10 on the right and left of a toilet bowl 5.

In these drawings, the toilet seat apparatus 10 which is designed so as to be mounted on the toilet bowl 5 comprises a casing main body 11, a nozzle unit 12 that is attached to the casing main body 11 to spout cleansing water toward excretory parts, an operation unit 13 that is equipped with operation buttons 13A (see FIG. 3) and indicator lamps 13B, a warm water/nozzle, controller 14 (see FIG. 2) to control the spouting of warm water and the shower nozzle positions according to the operations of the operating buttons 13A on the operation unit 13, a toilet seat 15 and a seat cover 15A. At an intermediate part (not shown in the drawings) of the casing main body 11 which supports the seat cover 15A, a dryer 80 (see FIG. 3) that dries the excretory parts of the human body by blowing warm air is incorporated. The dryer 80 comprises a dryer heater 81 for heating the air and a dryer fan 82 for blowing the heated air.

An external water source is connected with pipeline to a flushing water tank (not shown in the drawings) which stores flushing water to be flushed to a bowl part 5*a* of the toilet bowl 5 and, as in FIG. 2, is also connected with pipeline to supply water to the toilet seat apparatus 10 via coupling pipes 21 from a branching fixture 20 on the way.

The toilet seat apparatus 10 comprises, to start with the upstream side, a valve unit 26 which consists of a water supply adapter 22, a reducing valve 23, a solenoid valve 24 and a safety valve 25, a heat exchanger unit 32 which consists of a heat exchanger 30 that heats up the supplied water to an appropriate temperature with a cleansing water heater 29 while detecting the water temperature with a warm water thermistor 28*a* and a float switch 31 for detection of spout water state, a flow control unit 36 which consists of a check valve 33 and a flow control valve 35 that is driven by a flow control motor 34 and a closing valve unit 37 which consists of a first closing valve 37*a* and a second closing valve 37*b*, and a nozzle unit 12 is connected at the end. The nozzle unit 12 includes a drive unit 41 for driving a shower nozzle 40 in the axial direction.

The operations of the units related to the cleansing of the excretory parts of the human body sitting on the toilet bowl 5 are outlined respectively below. When a user sits on the toilet seat 15, a seat sensor 15*a* (see FIG. 3) outputs a signal of this information. When the operation unit 13 is operated afterward to press, for example, a posterior part cleansing button 13*a*, the drive unit 41 is driven to advance the shower nozzle 24 to the cleansing position as an integral unit and the first closing valve 37*a* of the valve unit 37 is opened to start spouting the cleansing water. The spouting force of the cleansing water is monitored, or detected, by a flow rate sensor 35*a* located on a downstream position of the flow control valve 35.

Not only the ON signals of the seat sensor 15*a* and the ON signals of the posterior part cleansing button 13*a* but also the signals to express the information that the cleansing shower nozzle 40 has or has not advanced to the posterior part cleansing position and the valve opening or valve closing signals of the first closing valve 37*a* are utilized by an electronic controller 100 for various kinds of processing. The electronic controller 100 signal to express the information that the cleansing shower nozzle 40 has advanced to the posterior part cleansing position is made into a data code with presence of output of a drive signal to the drive unit 41 and the signal to express the information that the cleansing shower nozzle 40 has not advanced to the posterior part cleansing position is made into a data code with absence of output of the drive signal to the drive unit 41 by a CPU 102 of the electronic controller 100 and stored at predetermined addresses in a backup RAM 107. This is the same with the valve opening and valve closing signals of the first closing valve 37*a*, which are made into a data code according to the circumstance of the output of the drive signal to the first closing valve 37*a*.

After completion of cleansing, when termination of cleansing is instructed by pressing a stop button 13*c* (see FIG. 3) on the operation unit 13, power supply to the cleansing water heater 29 is stopped and the solenoid valve 24 and the first closing valve 37*a* are closed to stop spouting of the cleansing water, and then the drive unit 141 is turned reverse to retreat the shower nozzle 40 to a storing position. When the genital cleansing button 13*b* is pressed, the shower nozzle 40 is advanced to a genital cleansing position and the second closing valve 137*b* is opened to start spouting of the cleansing water whereas cleansing is terminated by pressing the stop button 13*c*.

When a dryer button 13*d* is pressed after completion of cleansing, power is supplied to the dryer heater 81 and the dryer fan 82 of the dryer unit 80. The air heated by the dryer heater 81 is blown out as warm air by the dryer fan 82 toward the excretory parts of the human body to perform the excretory part drying. The drying is stopped by pressing the stop button 13*c*.

The toilet seat 15 is provided with a seat heater 53 to maintain the seat surface warm. The seat heating by the seat heater 53 is operated by pressing the ON/OFF button and the temperature setting is available.

In the above-described cases, the ON signals of the dryer button 13*d* and the stop button 13*c* and the other information, such as that the shower nozzle 40 has advanced to the cleansing position are utilized for various kinds of processing by the electronic controller 100 and stored respectively.

A circuit for controlling the cleansing water heater 29 and the seat heater 53 of the warm water/nozzle controller 14 has a structure centered with the electronic controller 100 which contains a micro computer shown in FIG. 3.

The electronic controller 100, shown in FIG. 3, comprises a CPU 102 wherein a variety of computational processing for such a purpose as a cleansing water temperature control based on preset programs are executed, a ROM 104 wherein control programs and control data that are necessary for executing the computational processing at the CPU 102 are stored in advance, a RAM 106 wherein data that are necessary for executing the computational processing at the CPU 102 are read and written temporarily, a backup RAM 107 wherein data are retained in memory even if no power is supplied, an input processing circuit 108 wherein signals from sensors and switches pertaining to the sanitary cleansing apparatus 20 are input and converted into the signals that can be processed by the CPU 102 and an output processing circuit 109 wherefrom signals are output to such as the solenoid valve 24 based on the operational result of the CPU 102. A variety of devices may be utilized as the backup RAM 107 wherein the data are not erased even if power supply is shut off, which can be backed up with an internal battery, including a device writable and readable electronically, such as a flash memory.

The operating buttons 13A on the operation unit 13, shown in FIG. 3, have various switches. Namely, a posterior part cleansing button 13*a*, a genital part cleansing button 13*b*, a stop button 13*c*, a dryer button 13*d* for blowing out warm air, a massage setting button 13*e* for selection of massage cleansing, a movable setting button 13*f* for selection of movable cleansing, a spout water temperature setting button 13*g* for spouting water temperature control, a flow control button 13*h* for flow rate control, a nozzle position adjustment button 13*i* for moving the shower nozzle 24 back and forth, and a reset button 13*k* for instructing a data resetting in a failure determination routine described below are provided. When these buttons are operated, this information (ON signals) is input into the electronic controller 100 and stored at predetermined addresses in the backup RAM 107.

Furthermore, the operation unit 13 is provided with a timer 16 for output of a predetermined ON signal (ON signal for continuous power supply) to the electronic controller 100 on expiration of a predetermined duration of time, for example about two hours, after start of power supply to the function parts, such as the cleansing water heater 29 and the seat heater 53. The timer 16 is designed for setting of the duration of time (two hours as described above) at the time of shipping from a factory or installation in a toilet and not designed for adjustment of the set time by a user at the time of normal use.

The toilet seat 15 is provided with the seat sensor 15*a* for the detection of sitting on such toilet seat 15, and the signal of such sensor (ON signal) is also input to the electronic controller 100 and stored at predetermined addresses in the backup RAM 107. For the seat sensor 15*a*, for example, a sensor for the detection of presence of the user on the toilet seat 15 by measuring transition in the capacitance of the seat heater 53 on the surface of the toilet seat 15 or a pressure sensor may be utilized. The setting conditions of the toilet seat apparatus 10 are indicated by the indicator lamps 13B consisting of LED and other components. The indicator lamps 13B are provided with various indicating functions to inform various operating conditions, abnormalities and presence of reservation in the timer. An attachment state sensor 17 for detecting the attachment and detachment of the toilet seat 15 to and from the toilet bowl 5 is also provided the backside of the toilet seat 15. The attachment state sensor 17 outputs a predetermined ON signal (ON signal for attachment) to the electronic controller 100 when the toilet seat 15 is attached to the toilet bowl 5, and stops input of such signal when the toilet sea 15 is detached.

Figure 4:
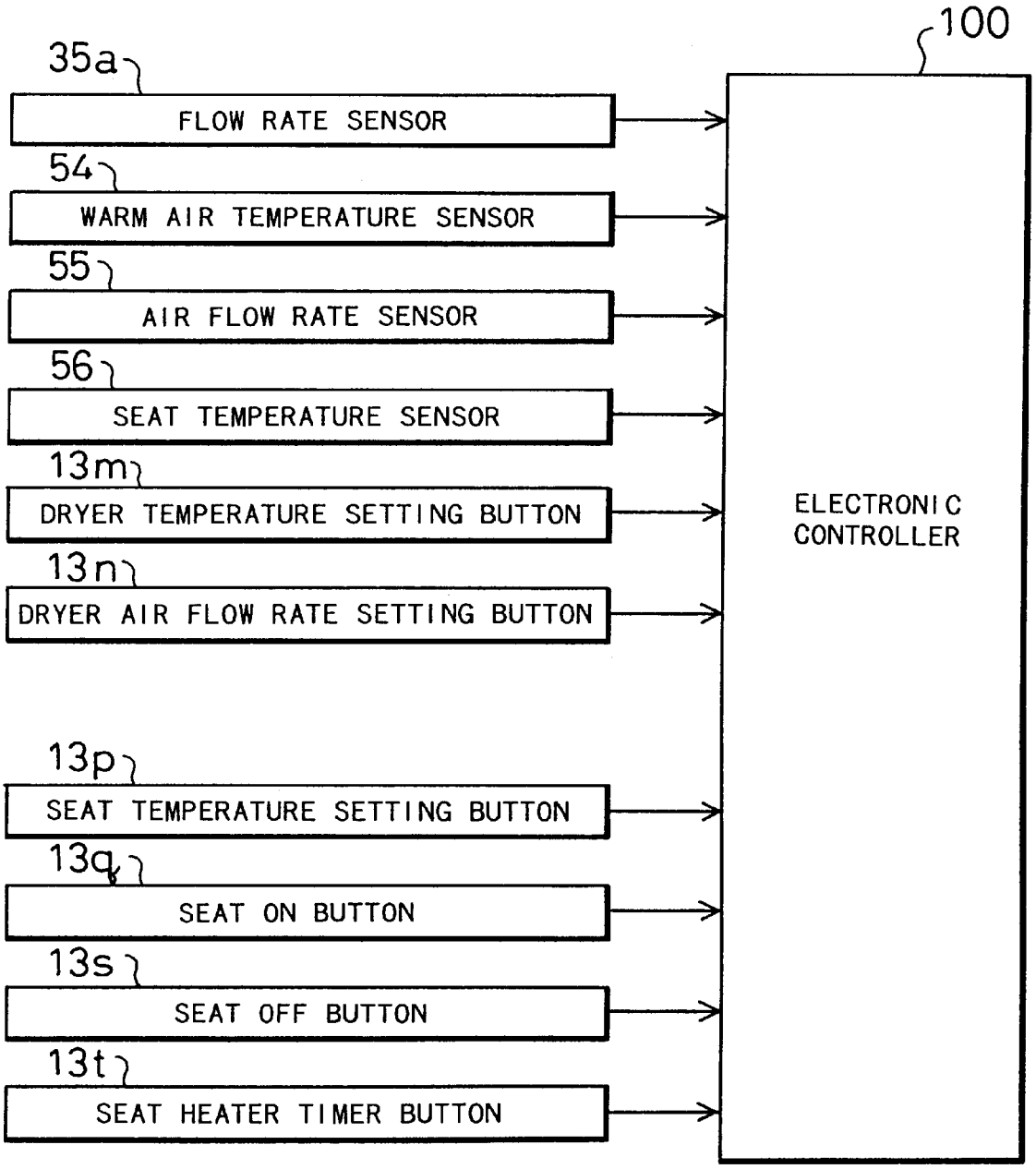
FIG. 4 is a block diagram showing the other input/output devices.

In addition to the above, the following sensors and buttons are connected to the input processing circuit 108 of the electronic controller 100. As shown in FIG. 4, pertaining to cleansing, a flow rate sensor 35*a* for detecting the spouting force of cleansing water from the shower nozzle 40 with the flow rate is connected to beside those shown in FIG. 3. Pertaining to the dryer unit 80, a dryer temperature setting button 13*m* for setting the temperatures of warm air blown out for drying excretory parts, a warm air temperature sensor 54 for detecting the warm air temperatures blown out and an air flow rate sensor 55 for detecting the air flow rate are connected to. Turning ON and OFF the excretory part drying is performed, as described above, with the dryer button 13*d* and the stop button 13*c*. When a fixed air flow rate is used for the excretory part drying, the dryer air flow rate setting button 13*n* is not necessary.

Pertaining to heating of the toilet seat 15, a seat temperature setting button 13*p* for setting the temperatures of the seat heater 53, a seat ON button 13*q* for turning on the seat heater 53, a seat OFF button 13*s* for turning off the same, a seat heater timer button 13*t* for maintaining the seat heater 53 on for a time zone except for the middle of the night and a seat temperature sensor 56 for detecting surface temperatures of the toilet seat 15 are connected to. The ON and OFF of the seat heater and the temperature setting buttons which are not operated frequently under usual use circumstances are located in such a place as the lateral side of a wing of the casing main body 11.

Figure 5:
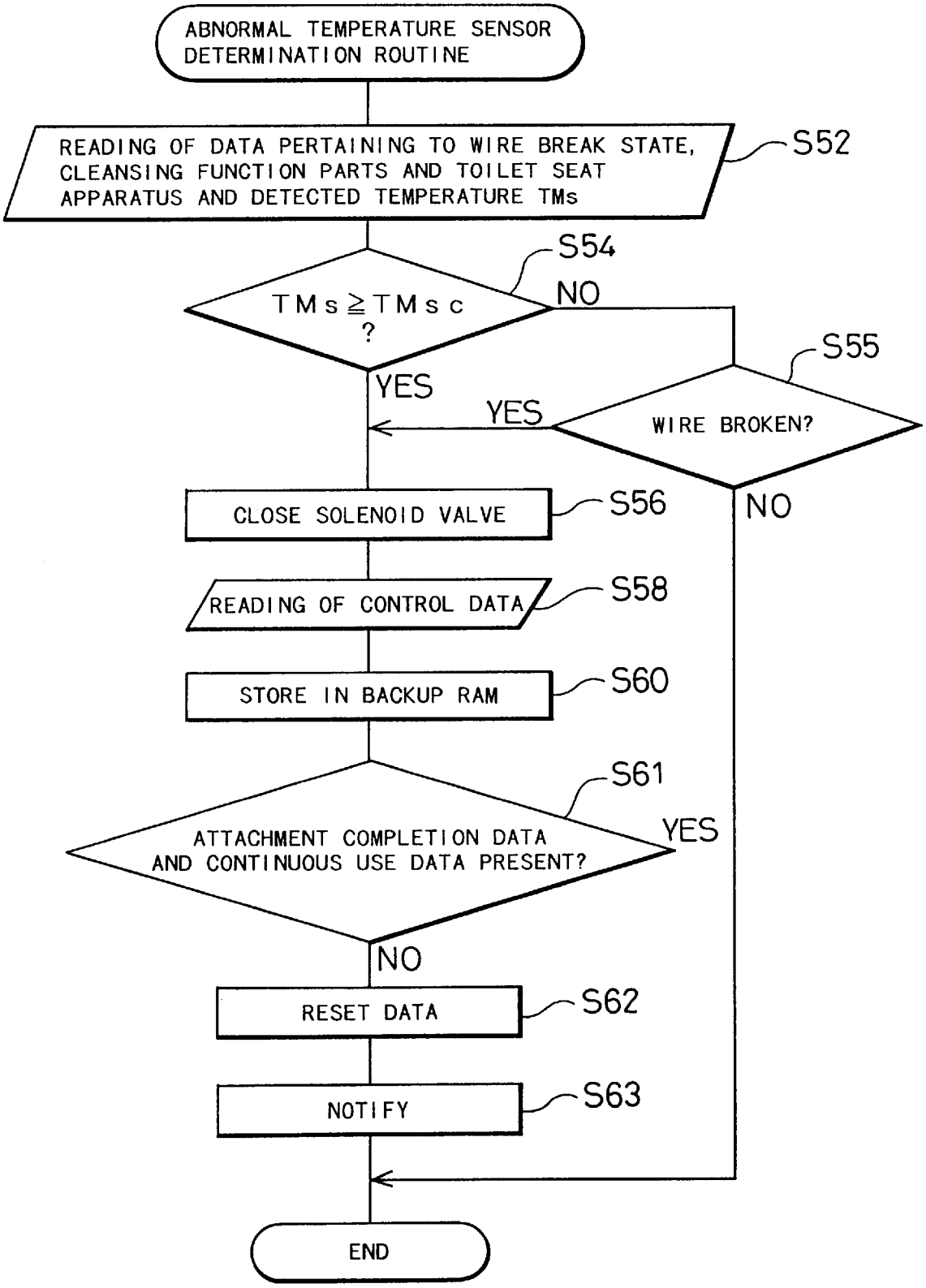
FIG. 5 is a flowchart showing a failure determination routine related to the toilet seat apparatus 10.

In the following paragraphs, a failure processing routine, pertaining to the toilet seat apparatus 10 and executed by the electronic controller 100, is described with references to FIG. 5.

To start with, at step S52, the various sensors and the timer are scanned and data of the entire toilet seat apparatus 10, not only the respective parts of the excretory cleansing mechanism, such as the nozzle unit 12, the valve unit 26, the heat exchanger unit 32, the flow control unit 36 and the closing valve unit 37 but also the excretory part drying and the seat heating, are read. Concretely, the various data pertaining to the excretory cleansing mechanism parts and the entire toilet seat apparatus 10 include occurrence of wire break based on the presence or absence of signals from the sensors, data which expresses the information of completion of attachment based on the ON signal of the attachment from the attachment state sensor 17 (attachment completion data) and data which expresses the information of the continuous use based on the ON signal of continuous power supply -from the timer 16 (continuous in-use data), and also the detected temperature TMs of the warm water thermistor 28*a*, are read.

Among the diverse information, the information on occurrence of wire break is a piece of information generated by the cleansing state information generating means for monitoring the excretory cleansing mechanism parts and drying means in the present invention and generating the data expressing the operating conditions of the means and is informative information which expresses the operating condition that the operations are disordered. The signals from various sensors are the data pertaining to the cleansing state information monitored and generated by the cleansing state information generating means in the present invention. For example, the signals from the warm water thermistor 28*a* is a piece of cleansing state information which expresses the operating conditions whereunder the cleansing water heater 29 has heated up the cleansing water warm. The signals from the timer 16 and the attachment state sensor 17 are the data pertaining to the monitored results of the use circumstance monitoring means in the present invention, and the time measurements prove whether in production process, under repair or usual use. The number of times of turning ON and OFF of the attachment state sensor 17 proves number of times of attachment and detachment of the toilet seat apparatus 10 to and from the toilet bowl 5.

At next step S54, whether or not the detected temperature TMs of the warm water thermistor 28*a* is not lower than the predetermined temperature TMsc. At this step, if the detected temperature TMs of the warm water thermistor 28*a* is lower than the predetermined temperature TMsc, the sequence proceeds to step S55 and whether or not the wire is broken is determined. If the wire is not broken, the program comes to the end of this routine; if the wire is broken, since the wire breakage should be noted in investigation into the causes of the trouble, the sequence proceeds to step S56 to store this information in a routine described below.

If the detected temperature TMs of the warm water thermistor 28*a* has been determined as not to be lower than the predetermined temperature TMsc at step S54, or, if an affirmative determination is made at step S55, the solenoid valve 24 is closed at step S 56. This inhibits spouting of hot water equal or higher than the predetermined temperature from the shower nozzle 40.

An alternative means for preventing hot water from being spouted from the shower nozzle 40 is to provide both a bypass channel (not shown in the drawings) which bypasses the shower nozzle 40 and a bypass valve on the bypass channel, wherein the bypass valve may be opened to discharge the hot water through the bypass channel.

At next step S58, other detected data of various conditions or control data, which are temporarily stored in the RAM 106, are read. The detected data and control data include the setting conditions of the various buttons of the operating buttons 13A and the above-described buttons pertaining to the seat heating, detected temperature peak values THs of the warm water thermistor 28*a*, signals that indicate the sitting conditions of the seat sensor 15*a*, signals that indicate whether or not water is being spout from the opened solenoid valve 24, signals that indicate whether or not the shower nozzle 40 advances either to the posterior part cleansing position or genital part cleansing position, warm air temperatures for excretory part drying and signals that indicate air flow rates.

In this case, the signals from the above-described setting buttons are the data pertaining to cleansing setting information that is generated by the cleansing setting information generating means in the present invention, and the signals from the seat sensor 15*a* are the data pertaining to the monitored results of the use circumstance monitoring means in the present invention, wherein the signals prove the number of times of use of the nozzle unit 12 and the dryer unit 80. The signals of information on whether or not the shower nozzle 40 advances either to the posterior part cleansing position or genital part cleansing position and the signals that indicate whether or not water is being spout from the opened solenoid valve 24 are the data pertaining to the cleansing state information monitored and generated by the cleansing state information generating means in the present invention. In an alternative structure, reading of these control data (step S58) may be performed before the closing process of the solenoid valve 24 (that is, output of valve closing signal) at step S56 or performed at the same time as such processing.

At next step S60, various data are stored in the backup RAM 107, and then, at step S61, whether or not the resetting of the memory is necessary is determined; at step S62, resetting of unnecessary data which are supposed not to pertain to the investigation into causes of trouble since they cannot occur during continuous use. That is, at step S60, if the detected temperature TMs of the warm water thermistor 28*a* is not lower than the predetermined temperature, it is probable that the heat exchange unit 32 which performs the temperature control is not operating effectively; therefore, the information that the detected temperature TMs is not lower than the predetermined temperature is added to the data pertaining to the cleansing function parts and units, which have been read at steps S42 and S58, such as detected data and control data of various conditions, attachment completion data based on the ON signal of the attachment state sensor 17 and continuous in-use data based on the ON signal of the continuous power supply at the timer 16, and stored in the backup RAM 107 together with the data of information on the wire breakage which has been determined at step S55. The data which have been read at the steps, such as S52, S55 and S58, are also stored at this time since these data are useful in investigation into the causes of troubles in case of various malfunctioning (for example, the above-described faulty temperature control)

When data are stored in the backup RAM 107, the memory is available in various modes. For example, a set of all the data to be stored may be accumulated and stored in a time series as a unit and, if a memory area that has been assigned in advance is fully used by storage of the units, the stored data of the past may be updated in a consecutive order to start with the oldest one. That is, the data for the period entirely covering both before and after the abnormal cleansing water temperature are accumulated and stored in a time series for a predetermined period of time (for example, from a few hours to tens of hours). In this case, the data leading to the abnormal cleansing water temperature can be obtained in a time series. Each unit of memory may be updated and stored consecutively It is also possible to confine the data to be stored to those that pertain to the investigation into the cause of the abnormal cleansing water temperature. Concretely, since the seat temperatures based on the seat heater 53 and the warm air temperatures based on the dryer heater 81 scarcely contribute to the causes of abnormal cleansing water temperatures, the data pertaining to the seat heating and the excretory part drying may be designed so as not to be stored. However, it is natural that, at step S54, the data related to the seat heater 53, the dryer heater 81 and others are also stored if, in addition to the abnormal cleansing water temperatures, the abnormal seat temperatures or the abnormal drying temperatures are determined on the basis of the outputs and set values of the concerned sensors.

At next step S61, whether or not reset of the data stored in the back up RAM 107 is determined through the determination on whether or not both the attachment completion data and the continuous in-use data are stored is determined That is, presence of both the above-described data proves that power has been supplied continuously to the excretory C parts, such as the cleansing water heater 29 and the seat heater 53, for a predetermined period of time after completion of attachment of the toilet seat 15 to the toilet bowl 5. The various data stored at this time are not the data stored in the backup RAM 107 at the tests in the production processes or during repair of the toilet seat 15 but the data stored at the time of normal use with the toilet seat apparatus 10 attached to the toilet bowl 5. Therefore, so long as both of the above-described data are present, the above-described various data remain stored in the back up RAM 107. If both of the above-described data are not present, the various data stored at this time are reset at step S62. Because the various data stored at this time are not the data under usual use circumstances of the toilet seat 15, so that, the various data stored at this time will not be involved investigation into the causes of the troubles. Since production of each toilet seat 15 that is equipped with the toilet seat apparatus 10 is usually completed approximately in one hour, it is reasonable to consider that data storage based on the ON signal of the continuous power supply of the timer 16 cannot be performed during continuous use.

After the above-described reset is performed once based on the attachment completion data and the continuous in-use data, the information that the reset based on both the data is stored for storage of various subsequent data and no more reset based on both the data will be performed. However, if power supply is resumed after stop of power supply due to repair or for other reasons, the above-described reset is performed based on both of the data.

When the ON signal of the reset button **13*k* is read at step S58, the data stored at the tests in the production processes are forcibly reset (or erased) by turning this button to ON at the time of shipping after completion of the production processes. In other cases, when the button is turned to ON at the time of attaching the toilet seat 15 to the toilet bowl 5 or at the time on completion of the work to recover from troubles, the signal of the reset button 13*k* is read at step S58, so that, the data stored at the tests in the production processes and the data stored at before time under usual use are forcibly reset (or erased) . Therefore, the data to be stored in the backup RAM 107** thereafter are the data pertaining to the causes of the troubles.

In this case, the contents of instructions through various buttons at the operating buttons 13A, for example, instruction of the posterior part cleansing through the posterior part cleansing button **13*a*, and the signal of whether or not the shower nozzle 40 has advanced to the posterior part cleansing position are stored in the backup RAM 107. If the data in the backup RAM 107 is not reset, congruity and incongruity between the contents of instructions from various buttons under usual use circumstances of the toilet seat 15 and the results of the operation based on the instructions can be also stored and kept At step S63 which succeeds the above-described step S62, in addition to the information on detection of the temperatures not lower than the predetermined temperature or of wire breakage together with the locations of the wire breaks, the information on resetting of the data which will not be involved in the investigation into the causes of the troubles and other information are indicated with the indicator lamps 13B, and this is notified. The various data stored at step S60** are continuously stored not only at the time of no power supply but also after resumption of the power supply, it is possible to continue the water spouting inhibition state, based on these data.

As described above, in this embodiment, when the warm water thermistor **28*a* detects the temperatures not lower than the predetermined temperature or when other failures, such as a wire break, occur, the information is stored together with the detection data, control data and other various data at that time in the backup RAM 107, and these data are modified according to the presence or absence of the attachment completion data and the continuous in-use data. This modification enables disuse of the data that were not obtained during the continual use but obtained at the tests in the production processes of the toilet seat apparatus as data for investigation into the causes of the troubles when failures occur. In other words, only the data obtained during use are utilized as the data for investigation into the causes of troubles. For this reason, in the toilet seat apparatus 10 of this embodiment, reliability of the data pertaining to the function parts, such as the cleansing water heater 29 and the toilet seat heater 53**, is enhanced when utilized as the analysis data for investigation into the causes of troubles and the causes of such troubles in the apparatus as described below can be investigated accurately.

That is, among the data stored in the backup RAM 107, setting conditions of the operating buttons 13A can indicate the accurate time and the conditions wherein whether or not the warm water thermistor **28*a* has detected temperatures not lower than the predetermined temperature, based on the control data, such as whether or not the posterior part cleansing button 13*b* was on, whether or not the stop button 13*c* was pressed and whether on or off the dryer button 13*d* was. It is also possible to indicate accurately whether or not the shower nozzle 40** and other parts were driven as instructed by the buttons.

Additionally, the sitting data detected by the seat sensor **15*a* can indicate accurately whether or not the failure occurred while the user was sitting on the toilet seat 15, and the detected temperature peak value THs if the warm water thermistor 28*a* and other data can indicate accurately whether or not the faulty part is the warm water thermistor 28*a*** itself.

More over, signals from the float switch 31 can indicate accurately whether or not the warm water thermistor **28*a* failed when the heat exchanger 30 was full of water and the control amount of the cleansing water heater 29** can indicate whether or not the cause was the heater control.

Figure 6:
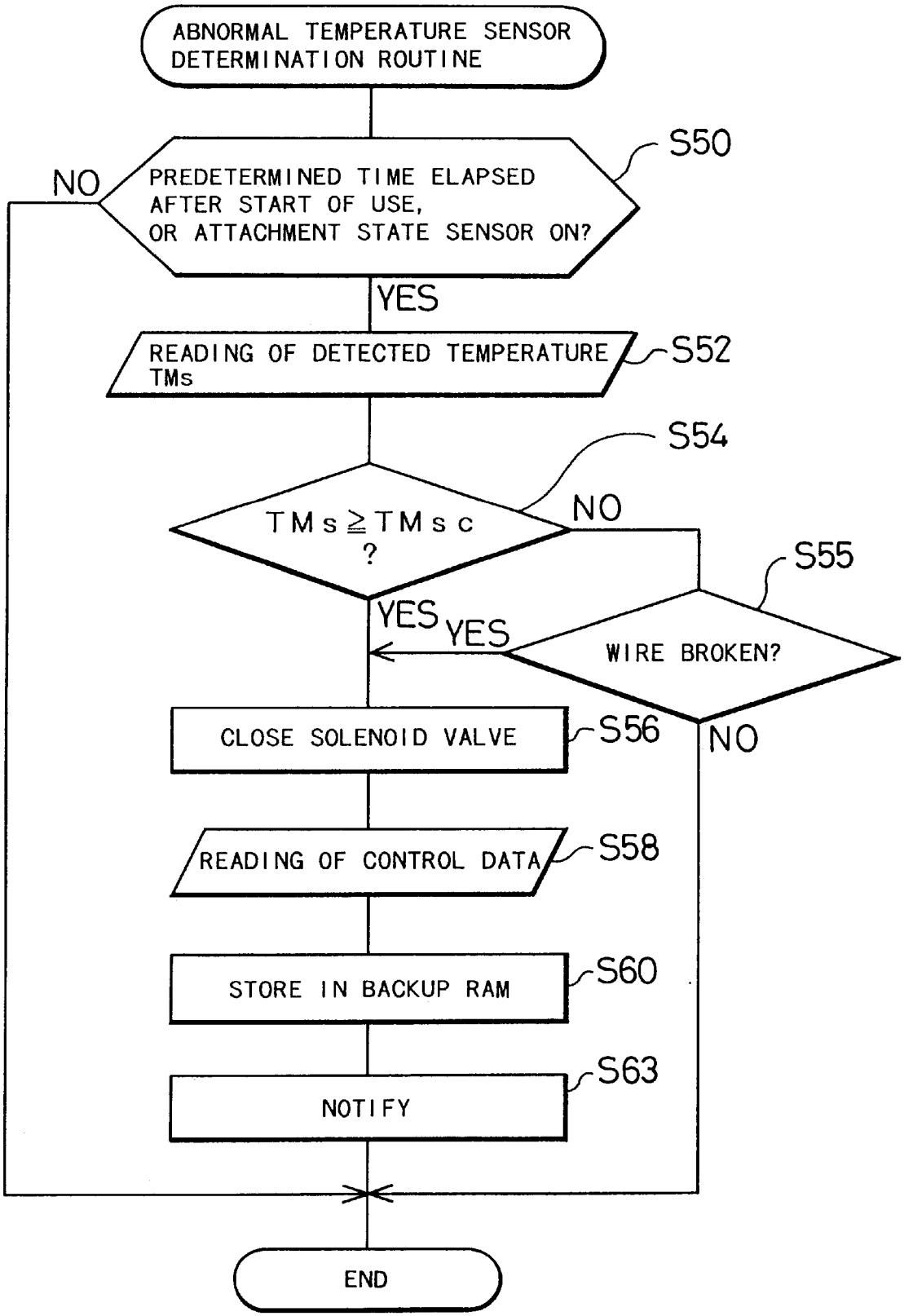
FIG. 6 is a flowchart showing a failure determination routine related to a modification of the toilet seat apparatus.

A modification of the above-described embodiment is described below. As shown FIG. 6, the failure determination routine is partly changed as follows. At step S50 which is the first step of this routine, whether or not a predetermined time has elapsed after starting to use the toilet seat 15 attached to the toilet bowl is determined with presence or absence of the ON signal of continuous power supply from the timer 16, or whether or not the attachment state sensor 17 is turned to ON is determined with presence or absence of the ON signal of attachment When either of the above is determined negatively, the routine comes to the end since the data pertaining to the function parts are determined so as not of continual use but of tests in the production processes. That is, in this case, the objects of storage in the backup RAM 107 are determined as zero and no data storage is performed. An affirmative determination at step S50 is followed by the above-described step S52 to investigate into the causes of the troubles with the data of the function parts which have been obtained during the continuous use. In this case, the detected temperature TMs of the warm water thermistor 28*a* is read.

The same processing as the above-described embodiment is performed at the steps from S52 to S58, which is followed by step S60. In the same way as step S60 of the above-described embodiment, the information that the detected temperature TMs of the warm water thermistor 28*a* was not lower than the predetermined temperature and various detected data and the control data of various conditions which were read at steps S58 are also stored in the backup RAM 107. The sequence shifts from this step S60 to step S63 of the above-described embodiment. In this modification of the embodiment, since the data obtained for the excretory cleansing parts during continuous use are also utilized in the investigation into the causes of the troubles, the causes of the troubles in the apparatus can be investigated accurately. The processing load can be reduced since the data are not stored if a negative determination is made at step S50.

The present invention is not restricted to the above embodiments or applications, but there may be many modifications, changes, and alterations without departing from the scope or spirit of the main characteristics of the present invention.

For example, the toilet seat apparatus 10 which performs ambient heating to heat the ambience of the toilet bowl by blowing out warm air around the toilet bowl (toilet room heating) and deodorization to suck the air inside the toilet bowl surface and remove odious smell from the air with ozone which is generated by the ozonizer besides basic functions of the toilet seat, such as excretory part cleansing, drying and seat heating, may have the following structure.

The heater unit 60 for ambient heating and the deodorizer unit 70 for deodorization are installed respectively in a left wing 11*a* and a right wing 11*b* of the casing main body 11 shown in FIG. 1.

Figure 7:
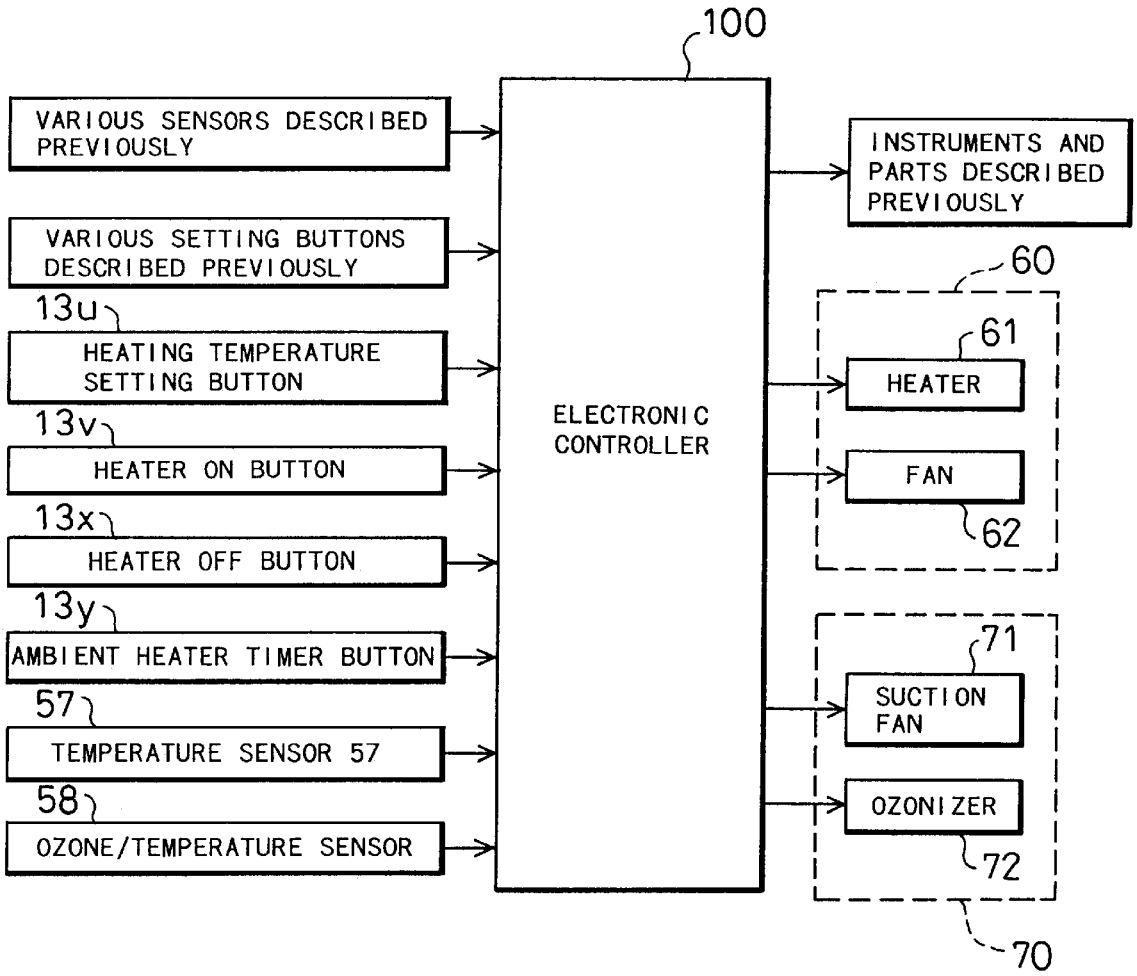
FIG. 7 is a block diagram showing the input/output devices pertaining to the ambient heating and deodorization.

As a block diagram of the input/output devices pertaining to the ambient heating and deodorization in FIG. 7 shows, the heater unit 60 comprises a heater 61 for heating the air (see FIG. 7) and a fan 62 for blowing the heated air. The deodorizer unit 70 comprises a suction fan 71 for sucking the air and an ozonizer 72 for generating ozone by electrically discharging to the air. These units are connected to the electronic controller 100. For the heating unit 60 for heating the ambience of the toilet bowl 5, a heating temperature setting button 13*u* for setting the heating temperatures, a heater ON button 13*v* for turning on the heater 61, a heater OFF button 13*x* for turning off the same, an ambient heater timer button 13*y* for keeping the heater 61 turned on for a time zone except for the middle of the night and a temperature sensor 57 for detecting ambient temperatures of the toilet bowl 5 are connected to. For the deodorizer 70 for deodorizing the inside of the toilet bowl 5, an ozone/temperature sensor 58 for detecting the generation of ozone by the ozonizer 72 indirectly from the ambient temperatures is connected to. The ON and OFF of the deodorizer unit 70 is performed by the ON and OFF of the seat sensor 15*a*.

In this structure, the signals from the setting buttons and the sensors are processed in the same way as those from the above-described flow rate sensor 35*a* and the posterior part cleansing button 13*a* and utilized as the analysis data of the causes of the troubles in the heater unit 60 and the deodorizer unit 70.

Although the reset button 13*k* for forcibly resetting the data is one of the operating buttons 13A in this structure, the reset button 13*k* may be provided on a remote controller. In this case, a receiving means for receiving the signals transmitted from the remote controller (reset signal) maybe provided on the operation unit 13 or other parts so that the signals are input into the electronic controller 100.

An alternative modification of the embodiment wherein various buttons of the operating buttons 13A, starting with the reset button 13*k*, are provided on the remote controller so as to set the shower unit 12 and others with this remote controller is described below.

When a plurality of the toilet seat apparatus 10 of this modification wherein the setting is performed with the remote controller are installed closely together in such a place as a public facility, it is necessary to prevent operations acted by the signals of the remote controller of adjoining toilets. The identification codes for identifying the toilet seat apparatus 10 need to be set and modified simply irrelevant to the place of installation, and the identification codes need to be retained after the toilet seat apparatus 10 are removed from the toilet bowls 5 for such a purpose as repair when they are set up once.

The processing in this modification of the embodiment comprises a routine for setting the identification code in the toilet seat apparatus main body and another routine for setting the same identification code in the remote controller.

Figure 8:
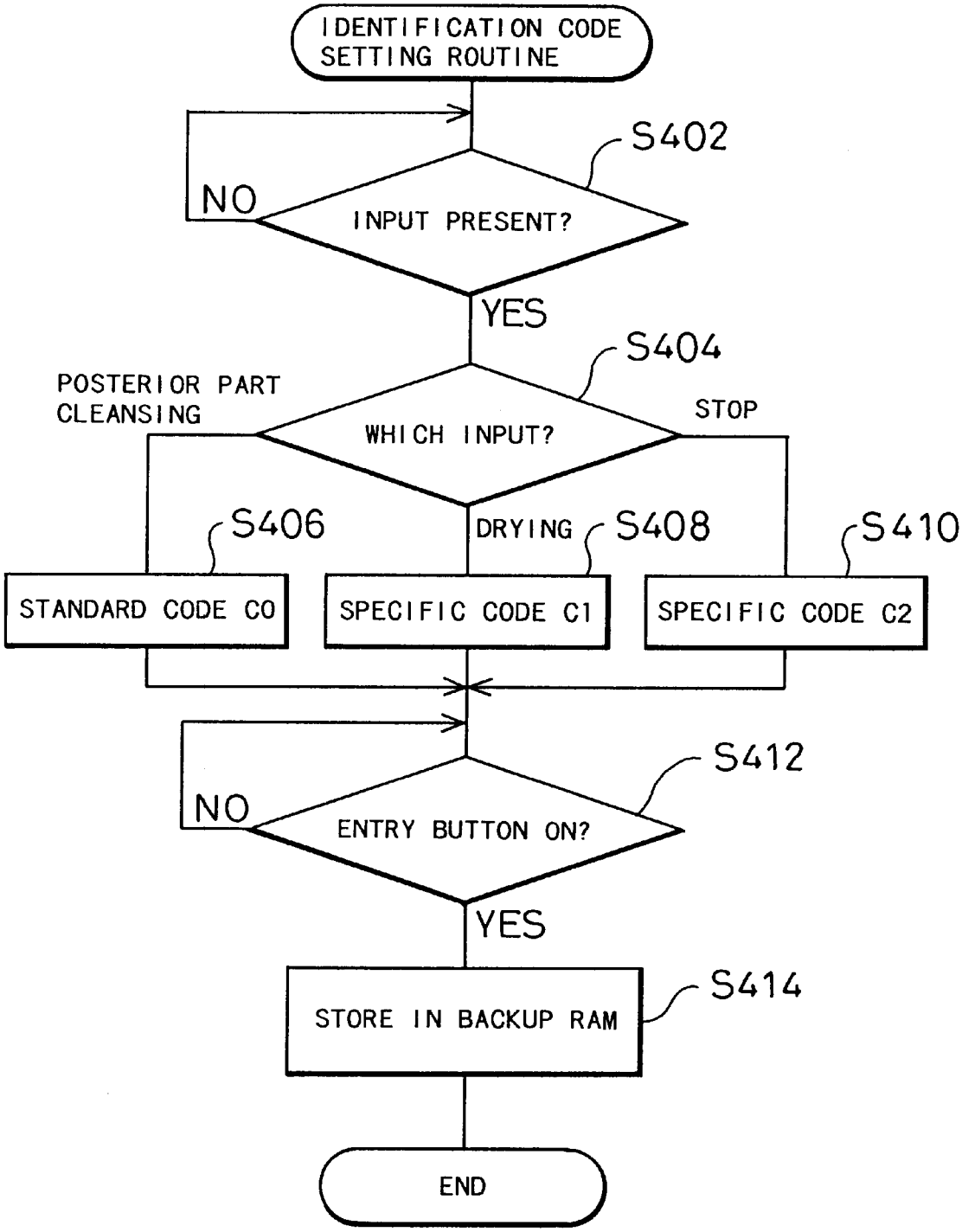
FIG. 8 is a flowchart showing the remote controller identification code setting routine.

First, with reference to the flowchart in FIG. 8, the setting of the identification code in the toilet seat apparatus main body is described. This routine is started when the power switch is turned on which the genital part cleansing button 13*b* is being pressed. The first step S402 is an input mode standby process. If any one of the posterior part cleansing button 13*a*, the dryer button 13*d* and the stop button 13*c* is pressed in this state, the sequence proceeds to the next step S404 to determine which button is pressed or not.

Through the determination process at step S404, an identification code, which corresponds to the selected button, is selected at steps S406, S408 and S410. A standard code C0 is selected at step S406 if the posterior part cleansing button 13*a* has been pressed, and a standard code C1 is selected at step S408 if the dryer button 13*d* has been pressed, while a standard code C2 is selected at step S410 if the stop button 13*c* has been pressed. These codes are stored beforehand in the ROM 104 and selectively read when the above-described corresponding buttons are pressed. At next step S412, if an entry button is determined to have been pressed, the selected identification code is stored at a predetermined address in the backup RAM 107.

The identification code setting on the remote controller side is carried out in almost the same way as the above-described processes. When battery cells are inserted into a battery box in the remote controller while the posterior part cleansing button is being pressed, the remote controller code setting mode is available. The same button as pressed on the toilet bowl among the buttons, which correspond, to the identification codes allocated in advance and then the entry button is pressed. This makes the same identification code, as set on the main body of the toilet seat apparatus is stored in the backup RAM 107 for the remote controller.

As described above, the setting of the same identification code on the toilet seat apparatus main body side and on the remote controller by selecting one code from a plurality of identification codes that have been allocated beforehand enables setting of an identification code which is selected from a plurality of identification codes and which is different from the one that has been set on the adjoining toilet seat apparatus 10. The identification code which has been set in this way is stored in the backup RAM 107 and cannot be erased even at power failure can be data to specify the apparatus According to this variation, when the toilet seat apparatus 10 with the remote controller are installed closely together in such a place as a public facility, different identification codes can be set for adjoining ones by a simple operation on the installation site toilets. Therefore, such complicated operations as cutting the patterns inside the control units of the toilet seat apparatuses main body and setting the identification codes with addition of jumper wires and resistors in production line or at installation site of the toilet seat apparatuses are no longer needed Although the identification codes are set both on the toilet seat apparatus main body and the remote controller, the following structure may be adopted to simplify further the operation so as to set only on the toilet seat apparatus main body. That is, the power switch is turned on while the genital part cleansing button 13*b* on the operation unit 13 of the toilet seat apparatus 10 is being pressed for shift to the remote controller identification code setting routine. Then, on transmission from the remote controller, the identification code contained in the transmission code is determined and stored in the backup RAM 107 in the toilet seat apparatus main body.

Therefore, if one remote controller, which is selected from a plurality of remote controllers wherein the identification codes have been set beforehand, is used for a transmission, the identification code, which is educed according to the signal that the toilet seat apparatus main body has received from the remote controller, is stored in the backup RAM 107 of the toilet seat apparatus main body; and thus the operations become much simpler with the identification code setting operations for the toilet seat apparatus 10 and the remote controller no longer needed. It is also possible to select one from the operation unit 13 of the toilet seat apparatus 10 for transmission to the remote controller. Besides the above, a special external input device may be utilized for setting the set codes for the toilet seat apparatus 10 and the remote controllers.

As described above, the toilet seat apparatus related to the present invention is appropriate for simplification of the investigation into the causes when troubles occur in the instruments and devices for realization of the various functions of the apparatus

We claim:

1. A sanitary cleansing apparatus for a toilet assembly comprising:

an excretory cleansing mechanism adapted to clean the excretory parts of the human body when sitting upon a toilet seat of the toilet assembly thereof;

a controller adapted to monitor the actual operating conditions of said cleansing mechanism and in response relatively continuously generating cleansing state signals representing the actual operating conditions thereof; and a first memory device configured to chronologically store said cleansing state signals during operation of said cleansing mechanism and in the event of a power loss thereto.

2. The sanitary cleansing apparatus according to claim 1 further including:

a first setting device configured to establish set operating conditions of said cleansing mechanism;

a cleansing setting generator adapted to generate cleansing setting signals representing the cleansing mechanism's set operating conditions set by said first setting device; and said first memory device is further configured to store said cleansing setting signals during operation of said cleansing setting generator and in the event of a power loss thereto.

3. The sanitary cleansing apparatus according to claim 2 further including:

a drying device configured to dry the excretory parts of the human body when seated upon said toilet seat; and a second setting device configured to establish set operating conditions of said drying mechanism;

said controller further being adapted to monitor the actual operating conditions of said drying device and in response generating drying device condition signals representing the actual operating conditions thereof, as part of the cleansing state signals; and said cleansing setting generator further being adapted to generate second setting signals representing the drying device's set operating conditions set by said second setting device, as part of the cleansing setting signals.

4. The sanitary cleansing apparatus according to claim 2 wherein, said first memory device includes a second malfunction memory device configured to record and store the circumstances causing malfunction of said controller and, record and store said cleansing setting signals at the time of occurrence of the malfunction.

5. The sanitary cleansing apparatus according to claim 1 wherein, said first memory device includes a first malfunction memory device configured to record and store the circumstances causing malfunction of said controller.

6. The sanitary cleansing apparatus according to claim 1 further including:

an environment monitoring mechanism adapted to monitor the actual state of the ambient environment of said toilet assembly; and said first memory device includes an environment memory device configured to record and store the actual state of the ambient environment of the toilet assembly as monitored by the monitoring mechanism.

7. The sanitary cleansing apparatus according to claim 1 further including:

a use circumstance monitoring device configured to monitor the use circumstances of said cleansing mechanism; and a memory result modification device adapted to modify the memory results in said first memory device according to the monitored results of said use circumstance monitoring device.

8. The sanitary cleansing apparatus according to claim 7 wherein, said use circumstances of said cleansing mechanism includes at least one of the use circumstances of the power supply to said sanitary cleansing apparatus, the use circumstances relating to the attachment of said sanitary cleansing apparatus to the toilet assembly, the number of times of use of said cleansing mechanism, and the number of times of attachment and detachment of said sanitary cleansing apparatus to and from the toilet assembly.

9. The sanitary cleansing apparatus according to claim 1 further including:

a use circumstance monitoring device configured to monitor the use circumstances of said cleansing mechanism; and a memory result modification device adapted to modify the information to be stored by said first memory device according to the monitored results of said use circumstance monitoring device.

10. The sanitary cleansing apparatus according to claim 1 further including:

a toilet seat heating mechanism adapted to heat said toilet seat;

a toilet seat state generator adapted to monitor the actual operating conditions of said toilet seat heating mechanism and in response generating toilet seat state signals representing the actual operating conditions thereof; and said first memory device further including a second memory device configured to chronologically store said toilet seat state signals during operation of said heating mechanism, and in the event of a power loss thereto.

11. The sanitary cleansing apparatus according to claim 10 further including:

a third setting device configured to establish set operating conditions of said toilet seat heating mechanism;

a toilet seat setting generator adapted to generate toilet seat setting signals representing the toilet seat heating mechanism's set operating conditions set by said third setting device; and said second memory device is further configured to chronologically store said toilet seat setting signals during operation of said heating mechanism, and in the event of a power loss thereto.

12. The sanitary cleansing apparatus according to claim 10 further including:

a use circumstance monitoring device configured to monitor the use circumstances of said cleansing mechanism and said toilet seat heating mechanism; and a memory result modification device adapted to modify the memory results in said first and second memory devices according to the monitored results of said use circumstance monitoring device.

13. The sanitary cleansing apparatus according to claim 12 wherein, said use circumstances of said cleansing mechanism and said heating mechanism include at least one of the use circumstances of the power supply to said sanitary cleansing apparatus, the use circumstances relating to the attachment of said sanitary cleansing apparatus to the toilet assembly, the number of times of use said cleansing mechanism and the toilet seat heating mechanism, and the number of times of attachment and detachment of said sanitary cleansing apparatus to and from the toilet assembly.

14. The sanitary cleansing apparatus according to claim 10 further including:

a use circumstance monitoring device configured to monitor the use circumstances of said cleansing mechanism and said toilet seat heating mechanism; and a memory result modification device adapted to modify the information to be stored by said first and second memory devices according to the monitored results of said use circumstance monitoring device.

15. The sanitary cleansing apparatus according to claim 1 further including:

an ambient heating mechanism adapted to heat the ambient environment of said toilet assembly;

an ambient state generator adapted to monitor the actual operating conditions of said ambient heating mechanism and in response generating ambient state signals representing the actual operating conditions thereof; and said first memory device further including a third memory device configured to chronologically store said ambient state signals during operation of said ambient heating mechanism, and in the event of a power loss thereto.

16. The sanitary cleansing apparatus according to claim 15 further including:

a fourth setting device configured to establish set operating conditions of said ambient heating mechanism;

an ambient setting generator adapted to generate ambient setting signals representing the ambient heating mechanism's set operating conditions set by said fourth setting device; and said third memory device is farther configured to chronologically store said ambient setting signals during operation of said ambient heating mechanism and in the event of a power loss thereto.

17. The sanitary cleansing apparatus according to claim 15 further including:

a use circumstance monitoring device configured to monitor the use circumstances of said cleansing mechanism and said ambient heating mechanism; and a memory result modification device adapted to modify the memory results in said first and third memory devices according to the monitored results of said use circumstance monitoring device.

18. The sanitary cleansing apparatus according to claim 17 wherein, said use circumstances of said cleansing mechanism and said ambient heating mechanism include at least one of the use circumstances of the power supply to said sanitary cleansing apparatus, the use circumstances relating to the attachment of said sanitary cleansing apparatus to the toilet assembly, the number of times of use said cleansing mechanism and the ambient heating mechanism, the number of times of attachment and detachment of said sanitary cleansing apparatus to and from the toilet assembly, and the season of the ambient environment.

19. The sanitary cleansing apparatus according to claim 15 further including:

a use circumstance monitoring device configured to monitor the use circumstances of said cleansing mechanism and said ambient heating mechanism; and a memory result modification device adapted to modify the information to be stored by said first and third memory devices according to the monitored results of said use circumstance monitoring device.

20. The sanitary cleansing apparatus according to claim 3 further including:

a deodorizing mechanism adapted to deodorize odious smell inside said toilet assembly;

a deodorizing state generator adapted to monitor the actual operating conditions of said deodorizing mechanism and in response generating deodorizing state signals representing the actual operating conditions thereof; and said first memory device further including a fourth memory device configured to chronologically store said deodorizing state signals during operation of said deodorizing mechanism, and in the event of a power loss thereto.

21. The sanitary cleansing apparatus according to claim 20 further including:

a fifth setting device configured to establish set operating conditions of said deodorizing mechanism; and a deodorizing setting generator adapted to generate deodorizing setting signals representing the deodorizing mechanism's set operating conditions set by said fifth setting device; and said fourth memory device is further configured to chronologically store said deodorizing setting signals during operation of said deodorizing mechanism and in the event of a power loss thereto.

22. The sanitary cleansing apparatus according to claim 21 further including:

a use circumstance monitoring device configured to monitor the use circumstances of said cleansing mechanism and said deodorizing mechanism; and a memory result modification device adapted to modify the memory results in said first and fifth memory devices according to the monitored results of said use circumstance monitoring device.

23. The sanitary cleansing apparatus according to claim 22 further including:

a use circumstance monitoring device configured to monitor the use circumstances of said cleansing mechanism and said deodorizing mechanism; and a memory result modification device adapted to modify the information to be stored by said first and fourth memory devices according to the monitored results of said use circumstance monitoring device.

24. The sanitary cleansing apparatus according to claim 23 wherein, said use circumstances of said cleansing mechanism and said deodorizing mechanism include at least one of the use circumstances of the power supply to said sanitary cleansing apparatus, the use circumstances relating to the attachment of said sanitary cleansing apparatus to the toilet assembly, the number of times of use said cleansing mechanism and the deodorizing mechanism, the number of times of attachment and detachment of said sanitary cleansing apparatus to and from the toilet assembly, and the season of the ambient environment.

25. The sanitary cleansing apparatus according to claim 1 wherein, said excretory mechanism includes a cleansing supply valve assembly, and said controller is adapted to monitor the actual operating conditions of valve assembly and in response relatively continuously generating cleansing state signals representing the actual opening and closing operating conditions thereof.

26. The sanitary cleansing apparatus according to claim 25 wherein, said valve assembly includes a flow control valve and a closing valve.

27. The sanitary cleansing apparatus according to claim 1 wherein, said excretory mechanism includes a flow rate sensor, and said controller is adapted to monitor the actual operating conditions detected by the flow rate sensor and in response relatively continuously generating cleansing state signals representing the actual operating conditions thereof.

28. The sanitary cleansing apparatus according to claim 1 wherein, said excretory mechanism includes a temperature sensor, and said controller is adapted to monitor the actual operating conditions detected by the temperature sensor and in response relatively continuously generating cleansing state signals representing the actual operating conditions thereof.

29. The sanitary cleansing apparatus according to claim 1 further including:

a forced modification mechanism adapted to forcibly modify the memory results in said first memory device.

* * * * *

UNITED STATES PATENT AND TRADEMARK OFFICE
CERTIFICATE OF CORRECTION

PATENT NO. : 5,898,956

DATED : May 4, 1999

INVENTOR(S) : Kurisaki *et al.*

It is certified that error appears in the above-identified patent and that said Letters Patent is hereby corrected as shown below:

At column 28, line 16, please change the word "farther" to --further--.

Signed and Sealed this

Third Day of October, 2000

*Attest:*

Q. TODD DICKINSON

*Attesting Officer*

*Director of Patents and Trademarks*